US010858985B2

(12) United States Patent
Naegele et al.

(10) Patent No.: US 10,858,985 B2
(45) Date of Patent: Dec. 8, 2020

(54) INTERNAL COMBUSTION ENGINE AND METHOD FOR ITS OPERATION

(71) Applicant: Andreas Stihl AG & Co. KG, Waiblingen (DE)

(72) Inventors: Claus Naegele, Stuttgart (DE); Matthias Hehnke, Schorndorf (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 16/298,001

(22) Filed: Mar. 11, 2019

(65) Prior Publication Data

US 2019/0323418 A1 Oct. 24, 2019

(30) Foreign Application Priority Data

Apr. 24, 2018 (DE) ..... 10 2018 003 476

(51) Int. Cl.
*F02B 25/02* (2006.01)
*F02M 23/03* (2006.01)
(Continued)

(52) U.S. Cl.
CPC ..... *F02B 25/02* (2013.01); *F02M 23/03* (2013.01); *F02M 23/06* (2013.01); *F02B 33/04* (2013.01);
(Continued)

(58) Field of Classification Search
CPC .... F02B 25/02; F02B 33/04; F02B 2075/025; F02M 23/03; F02M 23/06; F02M 2023/008; F02D 9/04
See application file for complete search history.

(56) References Cited

U.S. PATENT DOCUMENTS 4,445,468 A 5/1984 Onishi et al.
5,027,759 A * 7/1991 Luo ..... F02B 33/04 123/279
(Continued)

FOREIGN PATENT DOCUMENTS

DE 10 2005 059 927 6/2006
EP 2 670 956 12/2013
(Continued)

*Primary Examiner* — Syed O Hasan
(74) *Attorney, Agent, or Firm* — Gudrun E. Huckett

(57) ABSTRACT

An internal combustion engine has a cylinder with a combustion chamber and a piston supported reciprocatingly in the cylinder and delimiting the combustion chamber. A crankcase is connected to the cylinder and a crankshaft is rotatably supported therein. The piston is operatively connected to the crankshaft so as to drive the crankshaft in rotation. A transfer passage provides flow communication between crankcase interior and combustion chamber when the piston is at bottom dead center. The transfer passage has a port opening connecting the transfer passage to the crankcase interior and has a transfer port connecting the transfer passage to the combustion chamber. A fuel supply device supplies fuel into the transfer passage at a location between the transfer port and the port opening. The transfer passage has a connecting opening and is connected to the crankcase interior at the connecting opening. A control element controls the connecting opening.

14 Claims, 11 Drawing Sheets

(51) Int. Cl.

| | |
|---|---|
| ***F02M 23/06*** | (2006.01) |
| *F02B 33/04* | (2006.01) |
| *F02B 75/02* | (2006.01) |
| *F02D 9/04* | (2006.01) |
| *F02M 23/00* | (2006.01) |

(52) U.S. Cl.

CPC ..... *F02B 2075/025* (2013.01); *F02D 9/04* (2013.01); *F02M 2023/008* (2013.01)

(56) References Cited

U.S. PATENT DOCUMENTS

| | | | | |
|---|---|---|---|---|
| 5,033,418 | A * | 7/1991 | Maissant ..... | F02B 13/00 123/70 V |
| 5,033,419 | A | 7/1991 | Plohberger et al. | |
| 5,503,119 | A * | 4/1996 | Glover ..... | F02B 17/00 123/73 B |
| 5,740,767 | A | 4/1998 | Kaku et al. | |
| 2003/0010297 | A1 | 1/2003 | Strom et al. | |
| 2004/0003784 | A1* | 1/2004 | Rosskamp ..... | F02B 25/02 123/73 R |
| 2014/0060507 | A1 | 3/2014 | Hagawa et al. | |

FOREIGN PATENT DOCUMENTS

| | | |
|---|---|---|
| EP | 2 749 749 | 7/2014 |
| GB | 861605 | 2/1961 |
| JP | 58-178822 | 10/1983 |
| JP | 62-3121 | 1/1987 |

* cited by examiner

INTERNAL COMBUSTION ENGINE AND METHOD FOR ITS OPERATION

BACKGROUND OF THE INVENTION

The invention relates to an internal combustion engine comprising a cylinder in which a combustion chamber is formed and further comprising a piston that delimits the combustion chamber and that is reciprocatingly supported in the cylinder. The engine further comprises a crankcase in which a crankshaft is supported to be rotatable about an axis of rotation, wherein the crankshaft is driven in rotation by the piston about the axis of rotation. The engine further comprises at least one first transfer passage which, in the region of bottom dead center of the piston, produces a flow communication between the crankcase interior and the combustion chamber wherein the first transfer passage is connected by a first port opening with the crankcase interior and is connected with at least one first transfer port to the combustion chamber. The internal combustion engine comprises a fuel supply device that supplies fuel into the first transfer passage at a location between the first transfer port and the first port opening.

The invention further relates to a method for operating the internal combustion engine of the aforementioned kind.

U.S. Pat. No. 5,503,119 discloses an internal combustion engine, namely a two-stroke engine, that comprises a plurality of transfer passages. A fuel channel opens into a transfer passage which is arranged opposite to the outlet, wherein fuel is supplied through the fuel channel into the transfer passage. The transfer passages which are positioned at the circumference of the cylinder between the fuel-conveying transfer passage and the outlet are opened first upon downward stroke of the piston. In this way, it is to be achieved that the exhaust gases are to be substantially purged by clean air from the combustion chamber.

The invention has the object to provide an internal combustion engine of the aforementioned kind with which improved exhaust gas values can be obtained.

A further object of the invention resides in providing a method for operating the internal combustion engine that enables improvement of the exhaust gas values.

SUMMARY OF THE INVENTION

In accordance with the invention, this object is achieved in regard to the engine in that the first transfer passage comprises, in addition to the port opening and the first transfer port, a connecting opening, wherein the first transfer passage is connected at the connecting opening to the crankcase interior, and wherein a control element for controlling the connecting opening is provided.

With respect to the method, the object is solved in that the first transfer passage comprises, in addition to the port opening and the first transfer port, a connecting opening, wherein the first transfer passage is connected at the connecting opening to the crankcase interior, and wherein a control element for controlling the connecting opening is provided, wherein the control element in a first control position opens the flow cross section of the connecting opening and in a second control position at least partially closes off the flow cross section of the connecting opening, and wherein the control element, as a function of the engine speed of the internal combustion engine and/or as a function of a position of a throttle element of the internal combustion engine, is adjusted between the first control position and the second control position.

The internal combustion engine comprises a cylinder, a crankcase, and at least one first transfer passage. In the region of the bottom dead center of the piston, the transfer passage provides a flow communication between a crankcase interior and a combustion chamber formed in the cylinder. The first transfer passage is connected by a first port opening with the crankcase interior and is connected with at least one first transfer port to the combustion chamber. The transfer passage can be embodied in this context as a passage without branches, or it can be branched and comprise a plurality of transfer ports. The internal combustion engine comprises a fuel supply device that supplies fuel into the first transfer passage at a location between the first transfer port and the first port opening. In order to obtain minimal exhaust gas values, it is provided that the first transfer passage comprises, in addition to the port opening and the first transfer port, a connecting opening at which the first transfer passage is connected to the crankcase interior. The connecting opening is provided with a control element for controlling the connecting opening.

The port opening refers to the opening that connects the crankcase to the first transfer passage. The port opening can be provided in the crankcase or can be advantageously formed between the crankcase and the cylinder.

Advantageously, the connecting opening of the transfer passage that connects to the crankcase is closed when the control element is closed. When the connecting opening is closed, preferably no fuel/air mixture or no clean air passes through the connecting opening into the crankcase.

The fuel supply device can be a carburetor, an electronically controlled carburetor or a fuel injection device. The fuel injection device can inject the fuel advantageously into the intake passage, into the crankcase, and/or into at least one transfer passage.

The fuel supply device is provided for supply of fuel into the first transfer passage at a location between the first transfer port and the port opening. Accordingly, the fuel, depending on the control position of the control element, can be supplied into the first transfer passage or through the first transfer passage into the crankcase interior. For example, fuel, fuel/air mixture, or air can be supplied to the transfer passage when the connecting opening is closed.

When the connecting opening is closed, no fuel/air mixture can advantageously flow into the crankcase interior. Alternatively, a minimal proportion of fuel/air mixture can be supplied to the crankcase interior. In this case, the fuel/air mixture advantageously flows through the port opening into the crankcase interior. Alternatively, it can also be provided that a residual cross section of the connecting opening remains open and fuel/air mixture is supplied therethrough to the crankcase interior.

In advantageous alternative embodiments with additional transfer passages, it can be provided that substantially fuel-free air is advantageously supplied through these additional transfer passages when the connecting opening is closed. This air serves advantageously for purging exhaust gases from the combustion chamber. This is advantageous in particular at low engine speeds of the internal combustion engine, for example, at idle. The fuel is advantageously supplied substantially through the first transfer passage into the combustion chamber when the connecting opening is closed or substantially closed. In this way, it can be ensured that a sufficient fuel quantity reaches the combustion chamber even at low engine speeds.

The fuel quantity that is supplied per engine cycle is advantageously the fuel quantity injected for this engine cycle because the fuel quantity injected into the first transfer passage for each engine cycle is advantageously supplied to the combustion chamber. In this way, a precise metering of the fuel per engine cycle is possible, in particular when the internal combustion engine is hot. In particular when the internal combustion engine is cold, the fuel quantity supplied into the combustion chamber can deviate from the injected fuel quantity, for example, when the fuel precipitates on cold walls of the intake channel, of the transfer passage or of the crankcase and therefore is not supplied to the combustion chamber for this engine cycle.

Mixing with fuel/air mixture from preceding engine cycles in the crankcase interior can advantageously be avoided when the connecting opening is closed. When the connecting opening is closed, the comparatively minimal quantities of fuel required at idle can be metered well and supplied precisely for the given cycle into the combustion engine, in particular for a supply of the fuel immediately into the transfer passage. For engine cycles where no combustion is to take place, it is in particular possible to supply no fuel by means of the fuel supply device. Since there is advantageously also no significant quantity of fuel present in the crankcase, the combustion chamber is scavenged with substantially fuel-free air and scavenging losses at idle are reduced.

In particular at high engine speeds, it is advantageously provided that the connecting opening is open. Through the open connecting opening, fuel/air mixture can be supplied through the first transfer passage into the crankcase interior. The fuel/air mixture ensures, for example, a satisfactory lubrication of the moving parts in the crankcase interior. With open connecting opening, the section of the first transfer passage between the connecting opening and the port opening is advantageously without function. When the combustion engine is an engine with stratified scavenging, substantially the entire volume of the transfer passage between the at least one transfer port and the connecting opening is available for scavenging air. This is in particular expedient at high engine speeds, preferably at full load.

The internal combustion engine is advantageously an engine with stratified scavenging. The internal combustion engine is advantageously a piston-controlled engine with stratified scavenging. In the region of top dead center of the piston, the internal combustion engine comprises advantageously a supply channel for air. The supply channel for air is advantageously connected with the transfer passages near the transfer ports. The supply channel for air supplies advantageously fuel-free or substantially fuel-free air into at least one transfer passage, in particular into all transfer passages arranged near the outlet. As soon as the transfer ports open into the combustion chamber upon downward stroke of the piston, this substantially fuel-free air passes into the combustion chamber and pushes the exhaust gases out of the combustion chamber (scavenging action). Subsequently, advantageously fuel/air mixture flows into the combustion chamber. In this way, scavenging losses, i.e., the proportion of uncombusted fuel that escapes through the outlet is reduced.

Advantageously, it is provided that the control element in a first control position releases (opens) the flow cross section of the connecting opening. Advantageously, the control element in a second control position at least partially closes the flow cross section of the connecting opening. Intermediate positions of the control element in which the connecting opening is partially open can also be advantageous.

In a particularly preferred configuration, the control element in the second control position completely closes the flow cross section of the connecting opening. In this way, the entire fuel quantity is supplied to the transfer passage in the second control position. Alternatively, it can also be provided that the control element leaves open a minimal residual flow cross section of the connecting opening in the second control position so that minimal fuel quantities for lubrication of the moving parts in the crankcase can pass into the crankcase interior.

A complete closure of the connecting opening by the control element in the second control position is particularly advantageous when the internal combustion engine, in addition to the first transfer passage, has additional transfer passages. Since the control element in the second control position completely closes the flow cross section of the connecting opening, it is avoided that fuel can flow from the crankcase interior into the combustion chamber through the additional transfer passages. The fuel supply in such a further embodiment can thus be realized through the first transfer passage which is controlled by the control element. In this way, the combustion chamber scavenging action can be improved and transfer of uncombusted fuel into the outlet of the internal combustion engine can be reduced.

In an advantageous configuration, the control element is a mechanical control element. The control element can be in particular a rotary valve, a gate or a flap.

Advantageously, the control element is adjustable between the first control position and the second control position independent of the rotational position of the crankshaft. In an advantageous configuration, a control device for controlling the control element is provided. The control device can advantageously be an electric or an electronic control device. A mechanical control of the control element can also be advantageous.

In an advantageous embodiment, the control device is embodied for actuating the control element as a function of the engine speed of the internal combustion engine. Advantageously, at low engine speed, in particular at idle, the control element is in the second control position in which the control element at least partially closes off the flow cross section of the connecting opening. In this way, the fuel is mostly introduced, in particular completely introduced, into the first transfer passage at low engine speeds.

At high engine speeds, in particular at full load, it can be advantageously provided that the control element is in the first control position. In the first control position, the connecting opening is advantageously open. Accordingly, at high engine speeds the fuel can be introduced into the crankcase interior and a satisfactory lubrication of the moving parts in the crankcase interior is enabled.

Advantageously, it can be provided that the control element is in the second control position upon acceleration. In the second control position, the connecting opening is advantageously closed. Therefore, fuel that is supplied into the first transfer passage quickly reaches the combustion chamber, and the internal combustion engine reacts quickly to an acceleration desired by the operator.

It can also be advantageous that the control element, in the range of the final engine speed, is at least temporally in the second control position. In this way, metering of fuel into the combustion chamber can be realized precisely in accordance with the engine speed. Advantageously, in the range of the final engine speed, the control element is in the second control position only for a short period of time and at least temporally also in the first control position in order to ensure satisfactory lubrication of the moving parts in the crankcase.

It can be provided that upon deceleration, i.e, upon come down, the fuel supply is completely stopped. Advantageously, the control element is in the second control position when fuel is to be supplied again upon subsequent acceleration. Since the control element is in the second control position, the fuel supplied into the first transfer passage quickly reaches the combustion chamber. In this way, a delay is avoided when accelerating again.

The internal combustion engine comprises advantageously a throttle element that serves for controlling at least a partial quantity of the combustion air quantity supplied to the internal combustion engine. The combustion air in this context can be supplied as clean air or in the form of fuel/air mixture. The throttle element can be arranged in particular in an intake channel for air or in a supply channel for fuel/air mixture and can be actuated by an operator. The control device is embodied in an advantageous embodiment for actuation of the control element as a function of the position of the throttle element. The control element can be actuated as a function of the engine speed of the internal combustion engine and/or as a function of the position of the throttle element.

Advantageously, the internal combustion engine comprises means that interrupt at least partially, in particular completely, the connection of the crankcase interior to the combustion chamber through the first transfer passage in the first control position of the control element. In a particularly preferred embodiment, the control element itself forms the means for interrupting the connection of the crankcase interior to the combustion chamber through the first transfer passage. The first transfer passage can advantageously be divided into a first passage section and at least one second passage section. The first passage section of the first transfer passage comprises advantageously the connecting opening to the crankcase. The first passage section of the first transfer passage extends advantageously from the port opening to a point below the control element or all the way to the connecting opening. The second passage section of the transfer passage extends advantageously all the way to the transfer port, in particular from above the control element all the way to the transfer port. Advantageously, the control element closes in the first control position the second passage section of the first transfer passage. In this way, at least the second passage section of the first transfer passage is advantageously without function in the first control position of the control element. The second passage section of the first transfer passage between connecting opening and transfer port is closed. The first passage section between port opening and connecting opening is advantageously connected with both ends to the crankcase interior and is thus also without function.

Advantageously, the fuel supply device comprises a fuel valve. The fuel valve can be controlled advantageously such that fuel is introduced into the transfer passage only for a portion of an engine cycle. Particularly preferred, fuel is introduced into the transfer passage while the transfer ports are open to the combustion chamber and combustion air flows from the crankcase interior through the at least one transfer passage into the combustion chamber.

In an advantageous embodiment variant, it is provided that the fuel valve supplies the fuel into the first transfer passage. For this purpose, the fuel valve is advantageously arranged such that an outlet opening of the fuel valve for fuel is arranged at the first transfer passage. In this way, the fuel can be metered directly into the transfer passage so as to be precisely matched to the engine cycle. The fuel supply can be stopped in engine cycles in which no combustion is to take place.

In an alternative advantageous configuration it is provided that the internal combustion engine comprises an intake channel for supply of fuel/air mixture that opens into the first transfer passage. In this way, an improved fuel mixture preparation can be achieved. It can be provided that the fuel is supplied into the intake channel through a fuel injection valve. Also, other means for supply of fuel, for example, a carburetor, can be advantageous however. An outlet opening extends advantageously away from the combustion chamber. Through the outlet opening, exhaust gases can be guided out of the combustion chamber and, for example, guided to a muffler. The first transfer port is in particular arranged opposite to the outlet opening at the cylinder. Particularly preferred, at the circumference of the cylinder bore, between the first transfer port and the outlet opening, at least one additional transfer port of an additional transfer passage is arranged through which combustion air or mixture flows out of the crankcase interior into the combustion chamber. The combustion air which is flowing through the at least one additional transfer passage into the combustion chamber separates the incoming mixture that is flowing in through the first transfer passage into the combustion chamber from the exhaust gases flowing to the outlet opening. Advantageously, transfer of fuel immediately into the outlet opening can be largely avoided in this way.

Advantageously, at the first port opening a valve is arranged. The valve at the first port opening is in particular a check valve. In this way, the first port opening is open toward the crankcase interior only when the pressure in the transfer passage is smaller than the pressure in the crankcase, i.e., the transfer port is open toward the combustion chamber.

For supplying substantially fuel-free scavenging air, it is advantageously provided that the internal combustion engine comprises a supply channel for supply of substantially fuel-free air. The supply channel opens advantageously with an inlet opening at the cylinder bore. The supply channel is advantageously in at least one position of the piston, in particular in the region of top dead center of the piston, connected to at least one second transfer port of a second transfer passage. In this way, substantially fuel-free air can be provided as scavenging air in the at least one second transfer passage.

In order to enable in particular at full load a satisfactory air flow rate, in an advantageous embodiment it is provided that the inlet opening of the supply channel opens in the region of top dead center of the piston into the crankcase interior. For this purpose, the inlet opening is positioned such and the piston dimensioned such that the piston skirt at least partially opens the inlet opening at the cylinder bore in the region of top dead center of the piston. In other words, the piston opens advantageously at least partially the inlet opening at the cylinder bore in the region of top dead center.

In a method for operating an internal combustion engine, it is provided that the control element in a first control position opens the flow cross section of the connecting opening and in a second control position at least partially closes off the flow cross section of the connecting opening. The control element is advantageously adjusted as a function of the engine speed of the internal combustion engine between the first control position and the second control position.

Advantageously, it is provided that the control element, when surpassing a first engine speed that is above idle engine speed and/or when surpassing a first opening angle of the throttle element, is adjusted into the first control position and that the control element, when dropping below the first engine speed and/or when dropping below the first opening angle of the throttle element, is adjusted into the second control position. Above the first engine speed and/or above the first opening angle of the throttle element, the control element is thus always in the first control position in which the flow cross section of the connecting opening is open; below the first engine speed and/or below the first opening angle of the throttle element, the control element is in the second control position in which the control element at least partially closes off the flow cross section of the connecting opening. In this way, at low engine speeds that are below the first engine speed, and/or at minimal opening angles of the throttle element that are below the first opening angle, a comparatively minimal fuel quantity can be supplied into the transfer passage in a targeted fashion and thus also introduced in a targeted fashion into the combustion chamber. Advantageously, by introducing the fuel quantity into the transfer passage, in particular when the internal combustion engine is hot, it can be ensured that the entire supplied fuel quantity is available for the next combustion in the combustion chamber. In this way, a targeted fuel metering action is possible, in particular at low engine speeds and/or at small opening angles of the throttle element.

BRIEF DESCRIPTION OF THE DRAWING

Embodiments of the invention will be explained in the following with the aid of the drawings.

FIGS. 3 to 6 show schematically an engine cycle of the internal combustion engine of FIG. 1 at idle, wherein FIG. 3 shows the internal combustion engine shortly after bottom dead center upon upward stroke of the piston, FIG. 4 shows the internal combustion engine shortly before complete closure of the outlet opening, FIG. 5 shows the internal combustion engine at top dead center of the piston, and FIG. 6 shows the internal combustion engine during downward stroke of the piston.

FIGS. 7 to 10 show schematically an engine cycle of the internal combustion engine of FIG. 1 at full load, wherein FIG. 7 shows the internal combustion engine shortly after bottom dead center upon upward stroke of the piston, FIG. 8 shows the internal combustion engine shortly before complete closure of the outlet opening, FIG. 9 shows the internal combustion engine at top dead center of the piston, and FIG. 10 shows the internal combustion engine during downward stroke of the piston.

FIGS. 12 to 15 show schematically an engine cycle of the internal combustion engine of FIG. 11 at idle, wherein FIG. 12 shows the internal combustion engine at the beginning of the upward stroke of the piston, FIG. 13 shows that the inlet opening is connected to the transfer ports, FIG. 14 shows the internal combustion engine at top dead center of the piston, and FIG. 15 shows the internal combustion engine during downward stroke of the piston.

FIGS. 16 to 19 shows schematically an engine cycle of the internal combustion engine of FIG. 11 at full load, wherein FIG. 16 shows the internal combustion engine upon upward stroke of the piston, FIG. 17 shows that the inlet opening is connected to the transfer ports, FIG. 18 shows the internal combustion engine at top dead center of the piston, and FIG. 19 shows the internal combustion engine during downward stroke of the piston.

DESCRIPTION OF THE PREFERRED EMBODIMENTS

Figure 1:
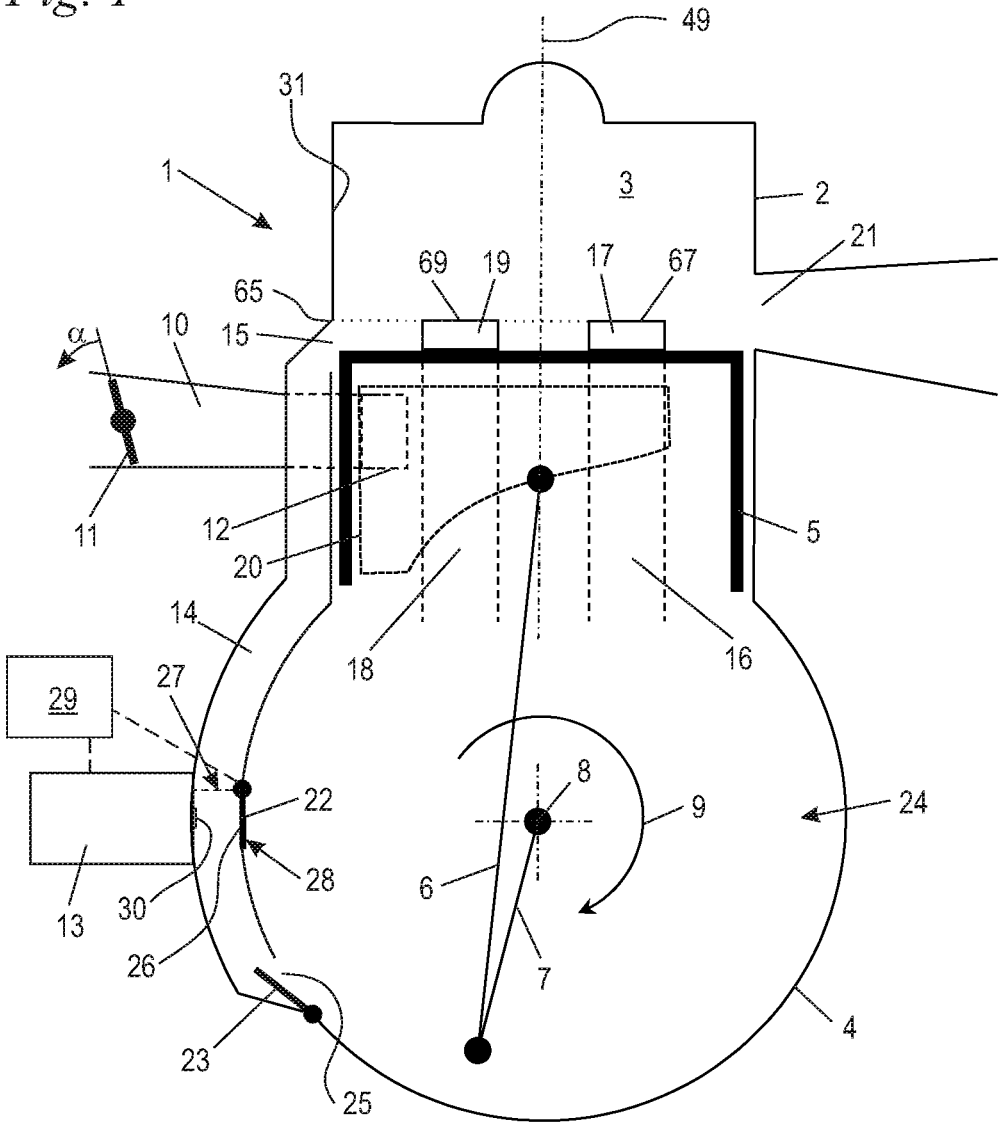
FIG. 1 is a schematic illustration of a first embodiment of an internal combustion engine.

FIG. 1 shows schematically an embodiment of an internal combustion engine 1. The internal combustion engine 1 is advantageously a two-stroke engine. In the embodiment, the internal combustion engine 1 is a single cylinder motor. The internal combustion engine 1 is advantageously the drive engine of tool a hand-guided power tool such as a motor chainsaw, a cut-off machine, a trimmer, a blower or the like. The internal combustion engine 1 comprises a cylinder 2 and a crankcase 4. A crankcase interior 24 is embodied in the crankcase 4 and a crankshaft 7, schematically illustrated in FIG. 1, is rotatably supported therein. In the cylinder 2, a piston 5 is supported to reciprocate in the direction of the longitudinal cylinder axis 49. The piston 5 separates a combustion chamber 3 embodied in the cylinder 2 from the crankcase interior 24. By means of connecting rod 6, the piston 5 drives in rotation the crankshaft 7 about an axis of rotation 8. The crankshaft 7 rotates in the embodiment in operation of the internal combustion engine 1 in the rotational direction 9. A supply channel 10 with inlet opening 12 opens at the cylinder 2. The inlet opening 12 is advantageously arranged at a cylinder bore 31 formed in the cylinder 2 and is piston-controlled by piston 5. In the supply channel 10, an adjustable throttle element 11 is arranged that can be opened advantageously by actuation of a throttle trigger by an operator. The throttle element 11 can be a throttle flap. The piston 5 is in the region of bottom dead center (BDC) in the position illustrated in FIG. 1.

The internal combustion engine 1 comprises a first transfer passage 14 that is connected by a transfer port 15 to the combustion chamber 3. The transfer port 15 is piston-controlled by piston 5. At its other end, the transfer passage 14 is connected by a first port opening 25 to the crankcase interior 24. The first port opening 25 can advantageously be controlled by a valve. In the embodiment, a pressure-controlled check valve 23 is provided, for example.

For supply of fuel, a fuel injection valve 13 can be provided. The fuel injection valve 13 is controlled by a control device 29 of the internal combustion engine 1. The fuel injection valve 13 is advantageously arranged at the transfer passage 14. In the embodiment, the fuel injection valve 13 supplies the fuel immediately into the first transfer passage 14. For this purpose, the fuel injection valve 13 comprises the fuel opening 30 arranged in the first transfer passage 14. An outlet opening 21 leads out of the combustion chamber 3. In the embodiment, the outlet opening 21 and the transfer port 15 of the first transfer passage 14, relative to the longitudinal cylinder axis 49, are arranged opposite each other at the cylinder bore 31.

The internal combustion engine 1 according to the embodiment of FIG. 1 can also comprise two second transfer passages 16 near the outlet 21 as well as two third transfer passages 18 remote from the outlet 21. Only one of the transfer passages 16 and 18 is illustrated, respectively. The transfer passages 16 and 18 are arranged mirror-symmetrical to each other relative to a section plane schematically illustrated in FIG. 1 in front of and behind the plane of the drawing. The transfer passages 16 are connected by transfer ports 17 to the combustion chamber 3. The transfer passages 18 are connected by transfer ports 19 to the combustion chamber 3.

The internal combustion engine 1 is an engine that operates with stratified scavenging. The supply channel 10 serves to provide scavenging air in the transfer passages 16 and 18. The piston 5 comprises at least one piston pocket 20. Through the piston pocket 20, the inlet opening 12 is connected in constructively predefined positions of the piston 5 to the transfer ports 17 and 19. In this way, air from the supply channel 10 can flow through the piston pocket 20 into the transfer passages 16 and 18. The supply channel 10 is connected only indirectly to the first transfer passage 14, i.e., through the crankcase interior 24. In the embodiment, the inlet opening 12 in the region of top dead center of the piston 5 is connected to the transfer ports 17 and 19 (see FIG. 8). The inlet opening 12 is advantageously arranged such that in the region of top dead center of the piston 5 it is not covered by the piston skirt of the piston 5 and therefore opens immediately into the crankcase interior 24.

As also shown in FIG. 1, the transfer port 15 comprises a top edge 65 which is facing away from the crankcase interior 24. The transfer port 17 comprises a top edge 67. The transfer port 19 comprises a top edge 69. In the embodiment, the top edges 65, 67, and 69 are positioned at the same level and are therefore simultaneously opened by the piston 5. In an advantageous embodiment variant, the top edges 65, 67, 69 can be positioned at a slant relative to the circumferential direction of the cylinder 2. Preferably, the top edges 65, 67, and 69 are arranged such that all transfer ports 15, 17, and 19 open at the same time into the combustion chamber 3 upon downward stroke of the piston 5.

Alternatively, it can also be provided that the top edges 65, 67, and 69 of the transfer ports 15, 17, and 19 are positioned at different levels for being connected to the combustion chamber 3. This can lead correspondingly to changed control times effected by the piston 5. For example, it can be provided in this way that the transfer ports 17 and 19 open first and only thereafter, upon further downward stroke of the piston 5, the transfer port 15 is opened. In this way, the combustion chamber 3 is first purged with substantially fuel-free air from the second and third transfer passages 16 and 18 before fuel/air mixture from the first transfer passage 14 passes through the transfer port 15 into the combustion chamber 3.

As shown in FIG. 1, the first transfer passage 14 comprises a connecting opening 26. The connecting opening 26 connects the first transfer passage 14 to the crankcase interior 24 at a location between the port opening 25 and the transfer port 15. The connecting opening 26 of the embodiment according to FIG. 1 is closed by the control element 22. The control element 22 is positioned in the illustration of FIG. 1 in a second control position 28. In the second control position 28, the connecting opening 26 is closed.

Figure 7:
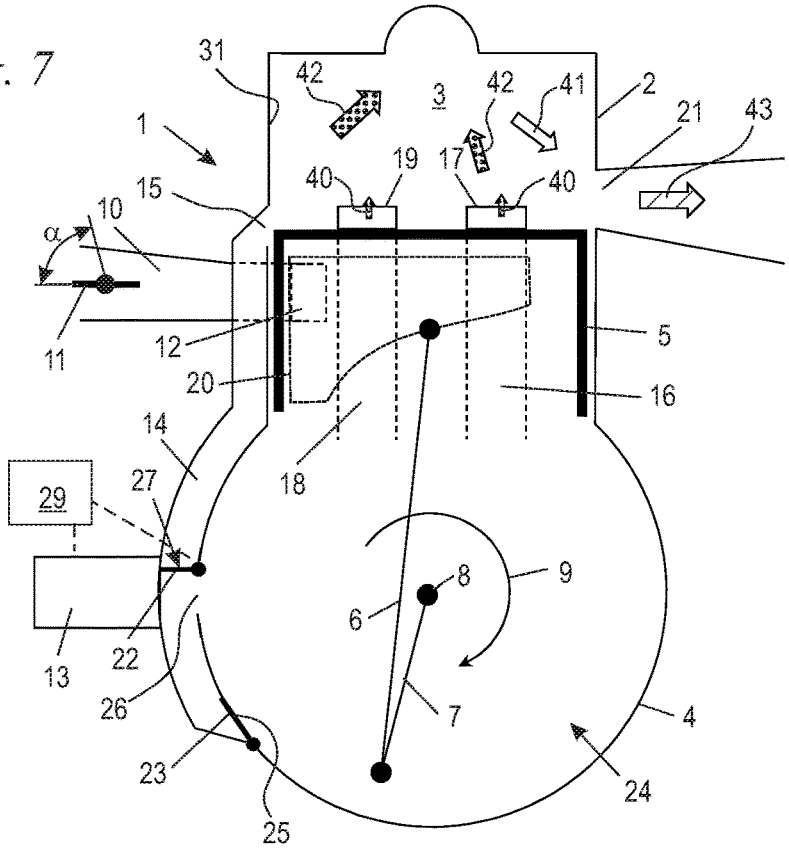

The control element 22 can be adjusted into a first control position 27 (FIG. 7). In the first control position 27, the connecting opening 26 connects the transfer passage 14 to the crankcase interior 24. Due to the controllable connecting opening 26, for example, the fuel injection valve 13 can supply fuel selectively into the transfer passage 14 or through the transfer passage 14 into the crankcase interior 24. The first control position 27 is schematically indicated in FIG. 1 with dashed lines. In the embodiment variant according to FIG. 1, a control element 22 is provided that advantageously completely closes off the connecting opening 26.

In an advantageous embodiment, it is provided that the control element 22 can be adjusted between the first control position 27 and the second control position 28 as a function of the engine speed. The control action of the control element 22 is realized advantageously by a control device 29 of the internal combustion engine 1.

Figure 2A:
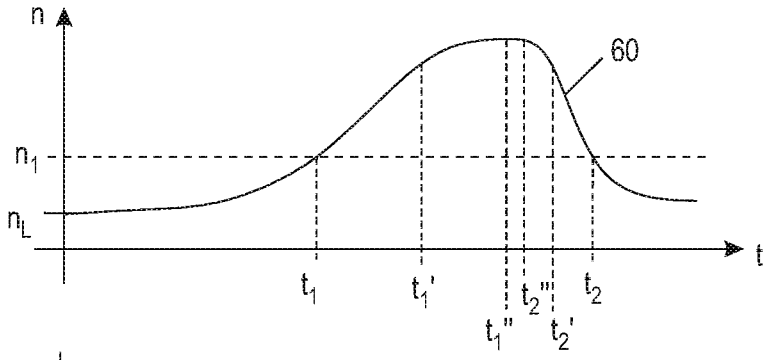
FIG. 2*a* is a schematic diagram that illustrates an exemplary course of the engine speed over time.

FIG. 2*a* shows schematically a possible exemplary course of the engine speed n of the internal combustion engine 1 over time t. The engine speed course is illustrated by line 60. As shown in FIG. 2*a*, the internal combustion engine 1 first operates at idle speed $n_L$. The engine speed n increases then and surpasses at the point in time $t_1$ a first engine speed $n_1$. The first engine speed $n_1$ then lies above the idle speed $n_L$. At the point in time $t_2$, the engine speed n drops below the first engine speed $n_1$.

Figure 2B:
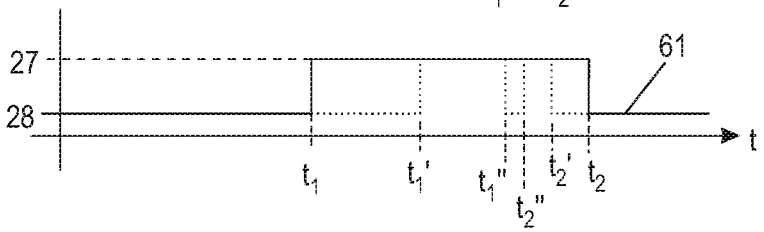
FIG. 2*b* shows a diagram that indicates the control positions of the control element over time for the engine speed course illustrated in FIG. 2*a*.

FIG. 2*b* shows an exemplary embodiment for the control positions 27 and 28 for the engine speed course as illustrated in FIG. 2*a*. As long as the engine speed n is below the first engine speed $n_1$, the control element 22 is in the second control position 28, as indicated by the line 61. At the point in time $t_1$ where the engine speed n surpasses the first engine speed $n_1$, the control element 22 is adjusted into the first control position 27. Up to the point in time $t_2$, the engine speed n is above the first engine speed $n_1$ and the control element 22 is in the first control position 27. At the point in time $t_2$ when the engine speed n drops below the first engine speed $n_1$, the control element 22 is adjusted from the first control position 27 into the second control position 28. The control element 22 is therefore adjustable independent of the rotational position of the crankshaft 7 solely based on the engine speed n of the internal combustion engine 1.

In addition to the described adjustment of the control element 22 as a function of the engine speed n, the control element 22 can be adjusted for further operating points into the second control position 28. For example, when accelerating, when at the final engine speed or when decelerating, the control element 22 can be adjusted into the second control position 28. This is indicated in FIG. 2*b* by the dotted line.

It can be provided that the control element 22 is adjusted into the first control position 27 only once a point in time $t_1'$ is reached. At the point in time $t_1'$, the engine speed n is greater than the first engine speed $n_1$. The point in time $t_1'$ is later than the point in time $t_1$. At the point in time $t_1'$, the acceleration drops below a predetermined value; the engine speed n thus increases less strongly than in case of the preceding strong acceleration.

At the point in time $t_1''$, the internal combustion engine 1 operates at a final engine speed at which an engine speed limiter becomes active. It can be provided that control element 22 is adjusted for a short period of time into the second control position 28, for example, up to a point in time $t_2''$ that follows the point in time $t_1''$. In this way, for engine speed limitation to the final engine speed, a revolution-precise metering of the fuel into the combustion chamber 3 can be realized. This is particularly advantageous when, for engine speed regulation, ignition is not to be performed for each engine cycle.

As indicated schematically in FIG. 2*b*, it can be advantageous to adjust the control element 22 into the second control position 28 already at the point in time $t_2'$ at which the internal combustion engine 1 decelerates. At the point in time $t_2'$, the engine speed n is significantly above the first engine speed $n_1$. Upon deceleration, the fuel supply is advantageously completely interrupted. By adjusting the control element 22 into the second control position 28, a delay can be avoided when accelerating again because fuel can reach quickly the combustion chamber 3.

In an alternative configuration, it is provided that the control element 22 is not adjusted between the first control position 27 and the second control position 28 as a function of the engine speed but as a function of an opening angle $\alpha$ of the throttle element 11. The opening angle $\alpha$ is schematically indicated in FIG. 1 and refers to the pivot angle of the throttle element 11, based on the closed position of the throttle element 11, in the direction toward the open position. In the closed position of the throttle element 11 illustrated in FIG. 1, the opening angle $\alpha$ amounts to 0°. In FIG. 7, the opening angle $\alpha$ is illustrated for the open position of the throttle element 11.

Figure 2C:
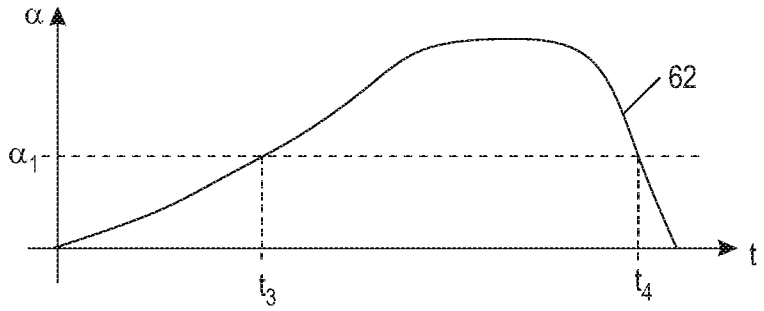
FIG. 2*c* shows a schematic diagram that indicates an exemplary course of the opening angle of the throttle element over time.

FIG. 2*c* shows schematically a possible course for the opening angle $\alpha$ as a line 62. The throttle element 11 is opened, beginning at the closed position. At the point in time $t_3$, the opening angle $\alpha$ surpasses the first opening angle $\alpha_1$. The throttle element 11 remains completely open for a short period of time and is then completely closed again wherein the opening angle of the throttle element 11 at the point in time $t_4$ drops below the first opening angle $\alpha_1$.

Figure 2D:
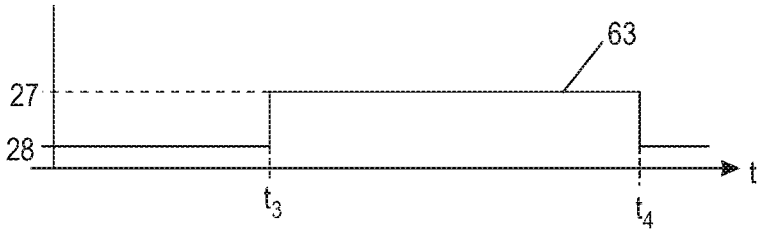
FIG. 2*d* shows a diagram that illustrates control positions of the control element for the course of the opening angle over time illustrated in FIG. 2*c*.

FIG. 2*d* shows an exemplary embodiment of the control positions 27 and 28 for the course of the opening angle $\alpha$ illustrated in FIG. 2*c*. As long as the opening angle $\alpha$ is below the first opening angle $\alpha_1$, the control element 22 is in the second control position 28. This is illustrated by line 63. At the point in time $t_3$ at which the opening angle $\alpha$ surpasses the first opening angle $\alpha_1$, the control element 22 is adjusted into the first control position 27. Up to the point in time $t_4$, the throttle element 11 is open past the first opening angle $\alpha_1$ and the control element 22 is in the first control position 27. At the point in time $t_4$ at which the opening angle $\alpha$ becomes smaller than the opening angle $\alpha_1$, the control element 22 is adjusted from the first control position 27 into the second control position 28. The control element 22 therefore can be adjusted independent of the rotational position of the crankshaft 7 based only on the opening angle $\alpha$ of the throttle element 11.

It can be provided that the control element 22, in addition to the adjustment as a function of the opening angle $\alpha$, can be adjusted into the second control position 28 for further operating points.

In a further advantageous alternative configuration, it is provided that the control element 22 is adjusted as a function of the opening angle $\alpha$ and as a function of the rotational speed of the crankshaft 7 between the first control position 27 and the second control position. The resulting course of the control positions 27 and 28 is schematically indicated as line 64 in FIG. 2*e*. An adjustment of the control element 22 from the second control position 28 to the first control position 27 is advantageously provided only once the engine speed n surpasses the predefined first engine speed $n_1$ and the opening angle $\alpha$ surpasses the predefined first opening angle $\alpha_1$. This is the case in the embodiment at the point in time $t_1$ because the point in time $t_3$ is before the point in time $t_1$. In the embodiment, the point in time $t_4$ at which the opening angle $\alpha$ becomes smaller than the opening angle $\alpha_1$ is after the point in time $t_2$ at which the engine speed n drops below the first engine speed $n_1$. An adjustment of the control element 22 from the first control position 27 into the second control position 28 is advantageously provided when the engine speed n drops below the first engine speed $n_1$ and when the opening angle $\alpha$ becomes smaller than the first opening angle $\alpha_1$. This is the case in the illustrated embodiment at the point in time $t_4$. At the point in time $t_4$, the control element 22 is adjusted from the first control position 27 into the second control position 28. Here also, an adjustment of the control element 22 into the second control position 28 can be provided additionally for further operating points.

Figure 2E:
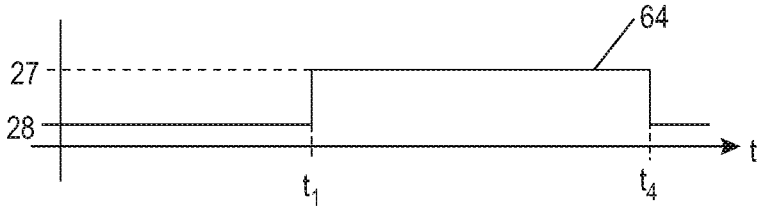
FIG. 2*e* shows a diagram that illustrates control positions of the control element for the engine speed course over time illustrated in FIG. 2*a* and the course of the opening angle over time illustrated in FIG. 2*c*.

In FIGS. 2*b*, 2*d*, and 2*e*, in an exemplary fashion a sudden adjustment of the control element 22 between the first control position 27 and the second control position 28 is illustrated. However, it can also be provided that the control element 22 is gradually adjusted between the first control position 27 and the second control position 28, for example, by pivoting the control element 22. The adjustment of the control element 22 can be realized such that the adjustment itself produces an engine speed reaction of the internal combustion engine 1. The adjustment of the control element 22 between the first control position 27 and the second control position 28 can however also be realized such that no noticeable engine speed reaction of the internal combustion engine 1 results.

In an alternative advantageous configuration, it is provided that the control element 22 opens and closes only the connecting opening 26 but does not close or open the transfer passage 14.

Figure 3:
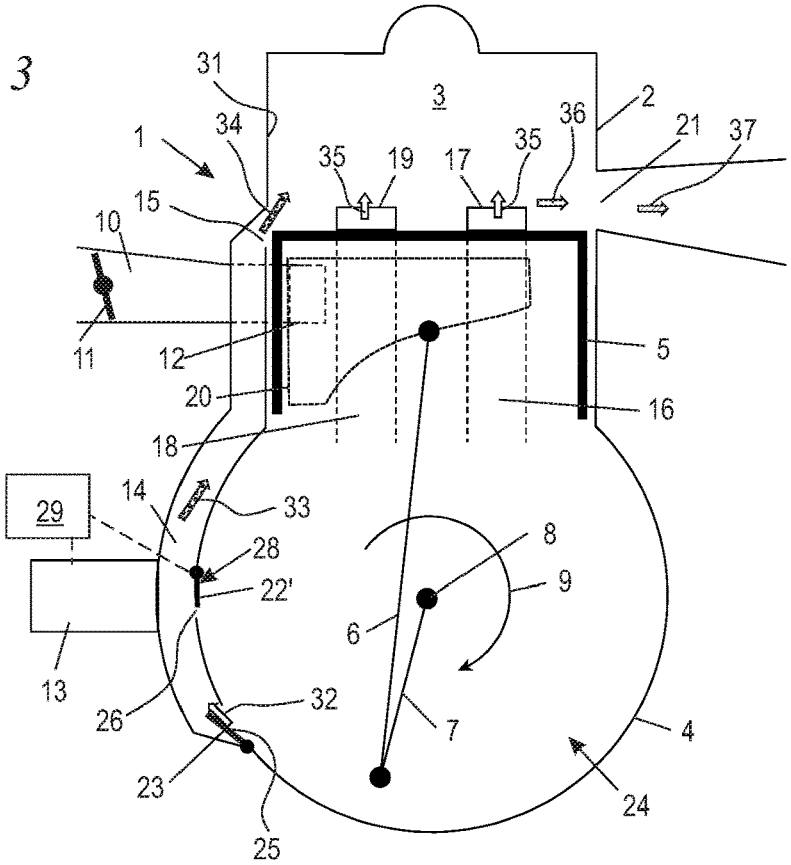
Figure 4:
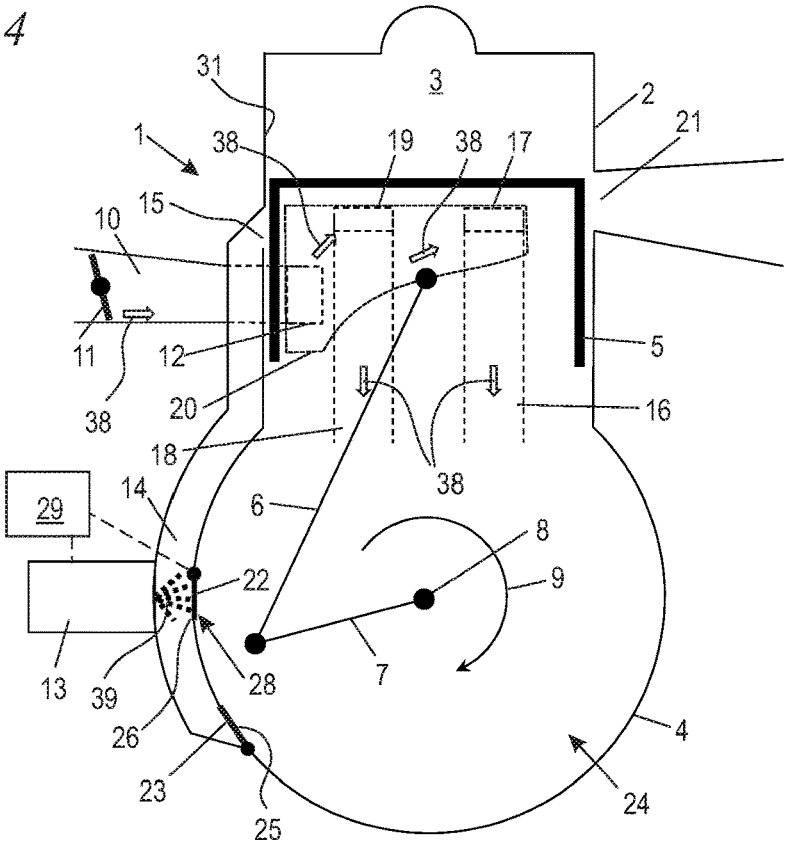
Figure 5:
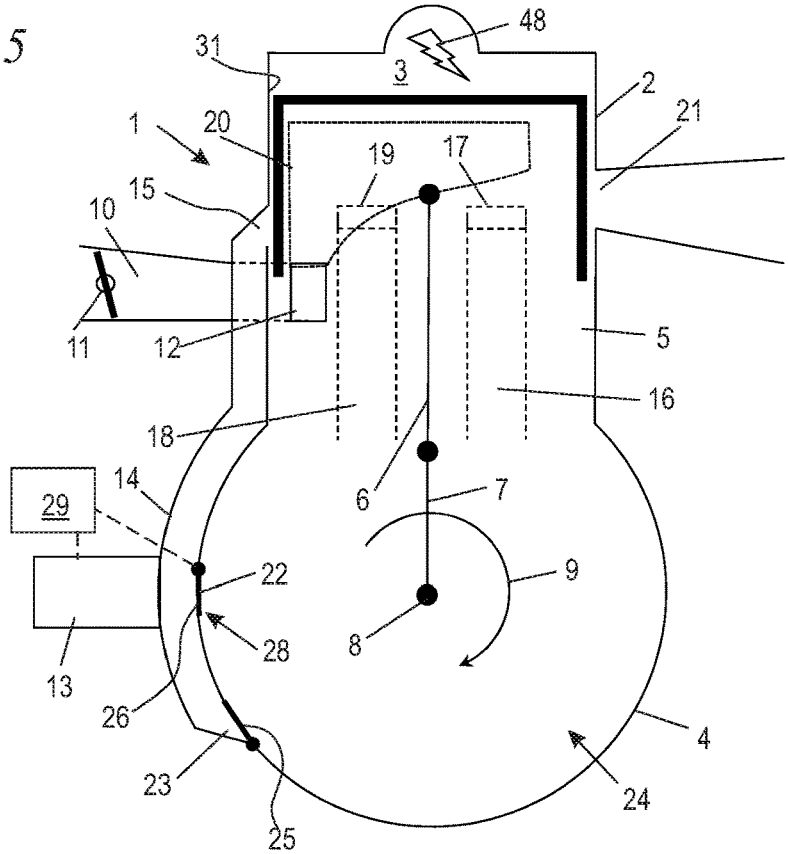
Figure 6:
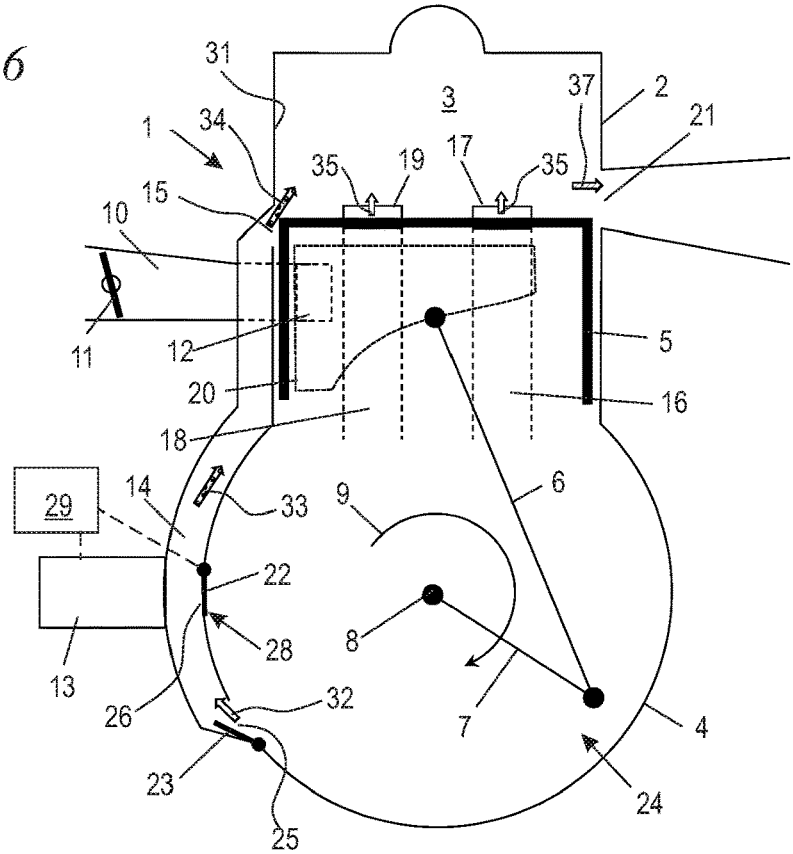

FIGS. 3 to 6 show schematically the flows of clean air, mixture, and exhaust gases which result during the course of one revolution of the crankshaft in the internal combustion engine 1 of FIG. 1. FIG. 3 shows the internal combustion engine 1 shortly after bottom dead center (BDC) of the piston 5. FIG. 4 shows the internal combustion engine 1 in a position during upward stroke in the direction toward top dead center (TDC) of the piston 5 shortly before complete closure of the outlet opening 21. FIG. 5 shows the internal combustion engine 1 at top dead center of the piston 5. FIG. 6 shows the internal combustion engine 1 during downward stroke of the piston 5 with largely open outlet opening 21 and partially open transfer ports 15, 17, and 19.

In FIG. 3, an embodiment variant of the internal combustion engine 1 is illustrated which is provided instead of the internal combustion 1 of FIG. 1. The embodiment variant of the internal combustion engine according to FIG. 3 differs in its configuration of the control element. In the internal combustion engine 1 in FIG. 3, a control element 22' is provided which in the second control position 28 does not completely close the connecting opening 26 but closes it only such that a residual cross section remains open. In the embodiment variant according to FIG. 1, a control element 22 is provided that completely closes the connecting opening 26.

The operation of the internal combustion engine 1 explained in the following with the aid of FIGS. 3 to 6 is independent of whether the internal combustion engine 1 comprises a control element 22 or a control element 22'.

FIG. 3 shows the internal combustion engine 1 shortly after bottom dead center during upward stroke of the piston 5. In this piston position, the check valve 23 at the port opening 25 of the first transfer passage 14 is open and substantially fuel-free air flows from the crankcase interior 24 into the first transfer passage 14, as illustrated by arrow 32. In the first transfer passage 14, a fuel mixture from the preceding injection is present which, in the direction of the arrows 33 and 34, flows through the first transfer passage 14 and the transfer port 15 into the combustion chamber 3. Substantially fuel-free air flows in the direction of the arrows 35 into the combustion chamber 3 from the transfer passages 16 and 18. The substantially fuel-free air flows in the direction of the arrow 36 in the direction toward the outlet opening 21 and pushes exhaust gases out of the combustion chamber 3. The exhaust gases flow in the direction of the arrow 37 through the outlet opening 21 out of the combustion chamber 3.

FIG. 4 shows the internal combustion engine 1 shortly before top dead center (TDC) of the piston 5. The outlet opening 21 is substantially closed and, during further upward stroke of the piston 5, the mixture contained in the combustion chamber 3 is compressed. The transfer ports 15, 17, and 19 are closed by the piston 5 relative to the combustion chamber 3. Via the piston pocket 20, the inlet opening 12 of the supply channel 10 is connected to the transfer ports 17 and 19. The internal combustion engine 1 is at idle. At idle, the throttle element 11 can be closed largely, in particular with the exception of a constructively predetermined residual cross section. Via the residual cross section, clean air can flow in the direction of the arrows 38 through the supply channel 10 and the inlet opening 12 into the piston pocket 20 and from there through the transfer ports 17 and 19 into the transfer passages 16 and 18. The transfer passages 16 and 18 are advantageously completely flushed with fuel-free air from the supply channel 10. Shortly before top dead center, fuel 39 is advantageously injected into the transfer passage 14. Shortly before top dead center, the transfer port 15 is closed by the piston 5 and the check valve 23 closes off the port opening 25 so that the first transfer passage 14 is closed off relative to the crankcase interior 24 as well as to the combustion chamber 3. Since the check valve 23 is closed, the fuel 39 cannot pass into the crankcase interior 24 despite vacuum being present in the crankcase interior 24. In an embodiment with control element 22 that completely closes off the connecting opening 26 in the second control position 28, a transfer of fuel 39 via the connecting opening 26 into the crankcase interior 24 is also not possible. The injected fuel 39 is therefore stored—so to speak—in the first transfer passage 14.

In the embodiment variant with control element 22' illustrated in FIG. 3, minimal quantities of fuel can pass into the crankcase interior 24. The fuel 39 which passes into the crankcase interior 24 serves, for example, for lubricating moving parts in the crankcase interior 24.

FIG. 5 shows the combustion engine 1 at top dead center of the piston 5. In the region of top dead center, the mixture in the combustion chamber 3 is ignited by a schematically illustrated spark plug 48 (FIG. 5). As shown in FIG. 5, the inlet opening 12 is arranged such that it opens to the crankcase interior 24 at top dead center of the piston 5. Therefore, from the supply channel 10 substantially fuel-free air flows immediately through the inlet opening 12, i.e., does not flow through the transfer passages 16 and 18, into the crankcase interior 24. In the embodiment, the inlet opening 12 at top dead center of the piston 5 is completely open relative to the crankcase interior 24. However, it can also be advantageous that the inlet opening 12 at top dead center of the piston 5 is open only partially relative to the crankcase interior 24. In an alternative embodiment, it can also be advantageous that the inlet opening 12 at top dead center of the piston 5 is closed off relative to the crankcase interior 24. The inlet opening 12 is then located advantageously in a section of the cylinder bore 31 which in any position of the piston 5 is covered by the piston skirt of the piston 5 or the piston pocket 20. In this way, the direct connection of the supply channel 10 to the crankcase interior 24 via the inlet opening 12 is closed off by the piston 5.

FIG. 6 shows the internal combustion engine 1 during downward stroke of the piston 5. During downward stroke of the piston 5, the outlet opening 21 opens and exhaust gases flow in the direction of the arrow 39 out of the combustion chamber 3. As soon as the transfer ports 15, 17, and 19 have been opened by the piston 5, through the transfer passages 16 and 18 substantially fuel-free air flows from the crankcase interior 24 in the direction of the arrows 35 into the combustion chamber 3. From the first transfer passage 14 mixture flows in the direction of the arrows 33 and 34 into the combustion chamber 3. From the crankcase interior 24, substantially fuel-free air flows through check valve 23, which during downward stroke of the piston 5 is open in the position illustrated in FIG. 6, in the direction of the arrow 23 into the first transfer passage 14. Subsequently, the next revolution of the crankshaft 7 begins in accordance with the sequence illustrated in FIGS. 3 through 6. The fuel 39 (FIGS. 6 and 3) which flows from the first transfer passage 14 into the combustion chamber 3 is thus the fuel injected during the preceding upward stroke (FIG. 4).

In the embodiment, the fuel 39 is injected into the first transfer passage 14 when the transfer port 15 is already closed. In an alternative embodiment, it is however also possible to inject the fuel 39 into the first transfer passage 14 while the transfer port 15 is open and combustion air flows from the crankcase interior 24 through the first transfer passage 14 into the combustion chamber 3.

Figure 8:
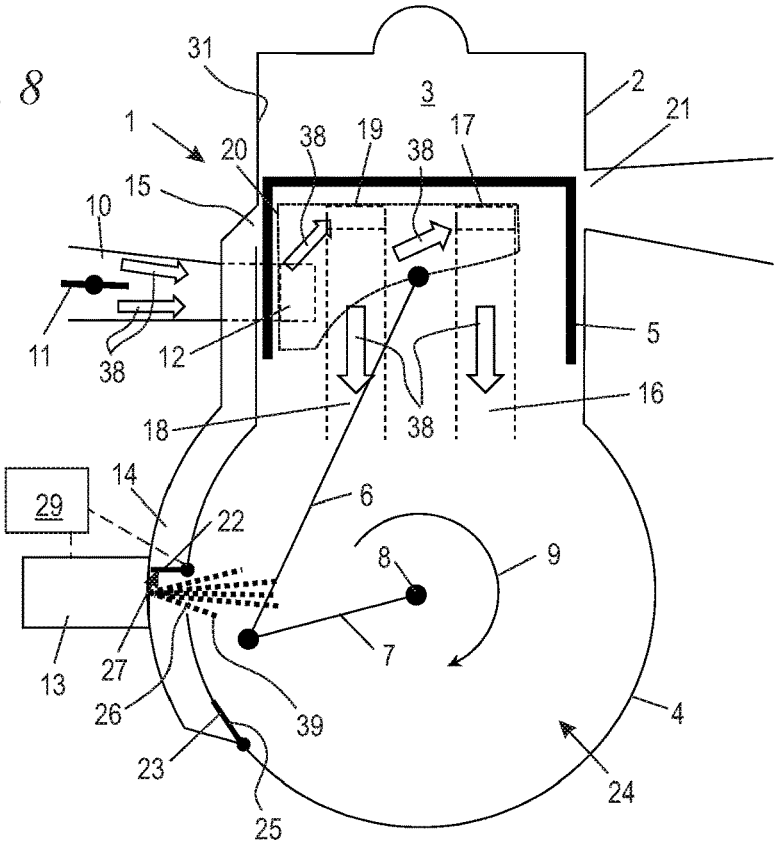
Figure 9:
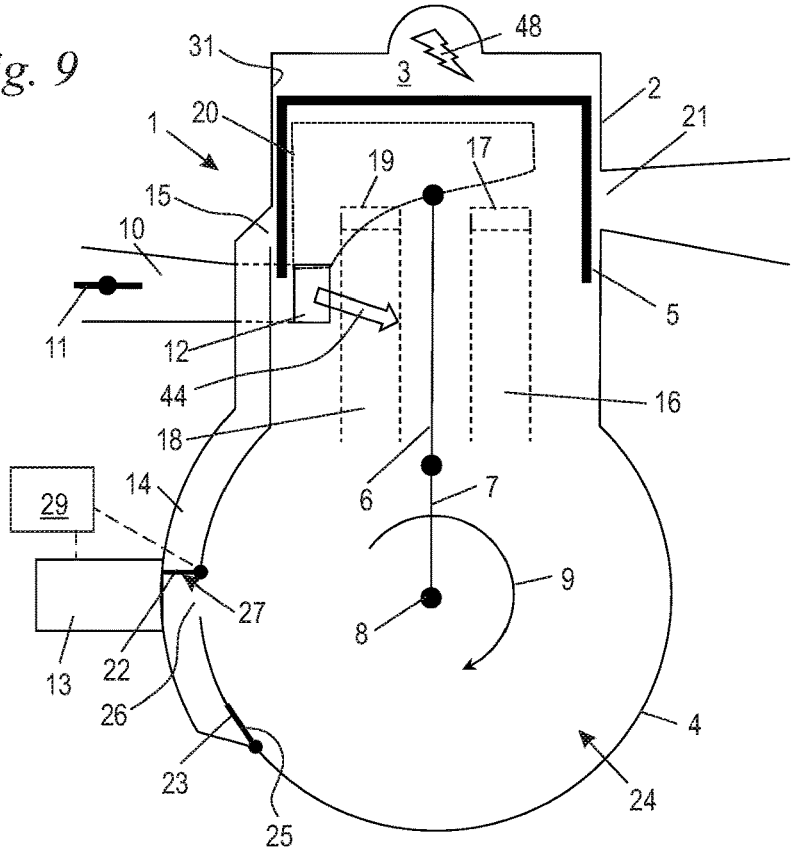
Figure 10:
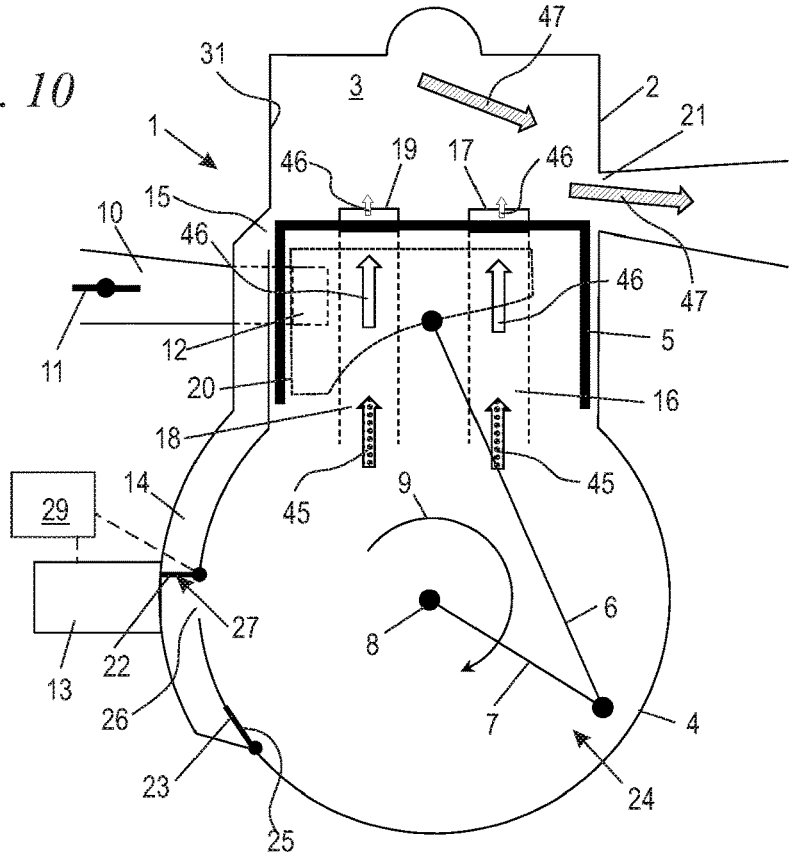

FIGS. 7 to 10 show the internal combustion engine 1 with completely open throttle element 11, for example, at full load. The piston position of FIG. 7 corresponds here to the piston position of FIG. 3, the piston position of FIG. 8 corresponds to the piston position of FIG. 4, FIG. 9 shows in accordance with FIG. 5 the piston 5 at top dead center, and FIG. 10 shows a piston position corresponding to FIG. 6.

As shown in FIGS. 7 through 10, the control element 22, when the throttle element 11 is completely open, is in its first control position 27. In this control position, the connecting opening 26 is completely open relative to the crankcase interior 24. The engine speed n of the internal combustion engine 1 with completely open throttle element 11 is higher than the first engine speed $n_1$ (FIGS. 2*a* and 2*b*) with closed throttle element 11.

During upward stroke of the piston 5, as shown in FIG. 7, exhaust gases flow out through the outlet opening 21 in the direction of the arrow 43. As schematically indicated by the arrow 41, clean air flows out of the combustion chamber 3 and pushes exhaust gases out of the combustion chamber 3. From the transfer passages 16 and 18, mixture flows in the direction of the arrows 40 and 42 into the combustion chamber 3. The first transfer passage 14 is closed off by control element 22 toward the transfer port 15. The first transfer passage 14 forms thus at least partially a dead volume. Advantageously, no mixture and no clean air flow through the first transfer passage 14 into the combustion chamber 3.

In the position illustrated in FIG. 8, the piston 5 during its upward stroke has substantially closed off the outlet opening 21. The transfer ports 15, 17, and 19 are closed off relative to the combustion chamber 3. The transfer ports 17 and 19 are connected by piston pocket 20 with the inlet opening 12 of the supply channel 10. In this way, clean air can flow in the direction of the arrows 38 through the supply channel 10 via the inlet opening 12 into the piston pocket 20 and from there through the transfer ports 17 and 19 into the transfer passages 16 and 18. The fuel injection valve 13 supplies fuel 39 through the first transfer passage 14 and through the connecting opening 26 into the crankcase interior 24. In the illustrated embodiment, the fuel injection valve 13 is arranged opposite to the connecting opening 26. In this way, the fuel 39 from the fuel injection valve 13 can be injected through the transfer passage 14 into the crankcase interior 24. The check valve 23 is closed in the positions of the piston 5 illustrated in FIGS. 7 and 8. The check valve 23 is in particular a diaphragm valve that due to the inherent stiffness of the diaphragm is pretensioned in the direction toward the closed position.

As shown in FIG. 9, the mixture is ignited at top dead center of the piston 5 by the spark plug 48. Through the inlet opening 12 clean air flows from the supply channel 10 in the direction of the arrow 44 into the crankcase interior 24.

As shown in FIG. 10, exhaust gases flow in the direction of the arrows 47 out of the combustion chamber 3 as soon as the piston 5 during its downward stroke opens the outlet opening 21. Through the transfer passages 16 and 18 and the transfer ports 17 and 19 clean air flows in the direction of the arrows 46 into the combustion chamber 3. The clean air is the clean air provided in the transfer passages 16 and 18 via the piston pocket 20, as has been described in connection with FIG. 8. From the crankcase interior 24, fresh mixture flows in the direction of the arrows 45 into the combustion chamber 3 through the transfer passages 16 and 18. At least one passage section of the first transfer passage 14 is without function in the first control position 27 of the control element 22. The check valve 23 remains closed because both sides of the check valve 23 are loaded by the pressure of the crankcase interior 24.

Figure 11:
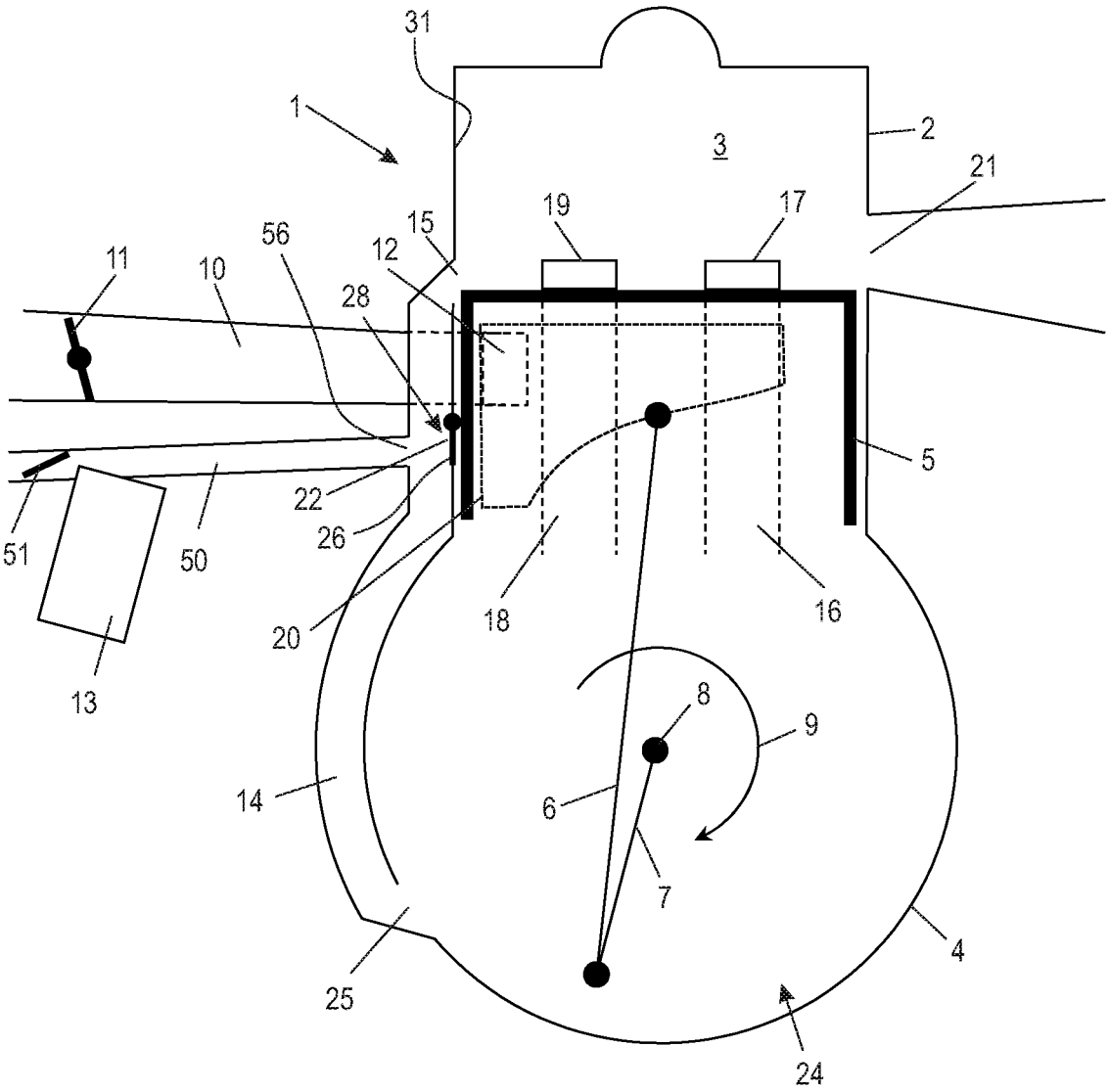
FIG. 11 is a schematic illustration of a further embodiment of an internal combustion engine.

FIG. 11 shows a further preferred embodiment of an internal combustion engine 1. The internal combustion engine 1 of the embodiment according to FIG. 11 comprises a supply channel 10 and an intake channel 50. Same reference characters refer in this context to corresponding elements as shown in the preceding Figures. Fuel/air mixture is supplied via the intake channel 50. A check valve 51 is arranged in the intake channel 50. In the embodiment, for example, the fuel injection valve 13 supplies fuel into the intake channel 50. Alternatively, other fuel supply devices can be provided also, for example, an electronically controlled carburetor. The intake channel 50 is connected with an opening 56 to the first transfer passage 14. In the embodiment according to FIG. 11, the opening 56 is arranged opposite to a connecting opening 26 of the first transfer passage 14. The connecting opening 26 connects the first transfer passage 14 to the crankcase interior 24 between the port opening 25 and the transfer port 15. In the embodiment according to FIG. 11, the connecting opening 26 is arranged at the cylinder bore 31 in a region that is crossed by the piston skirt of the piston 5 during every piston stroke. FIG. 11 shows the control element 22 in its second control position 28 in which the connecting opening 26 is closed by the control element 22.

Figure 12:
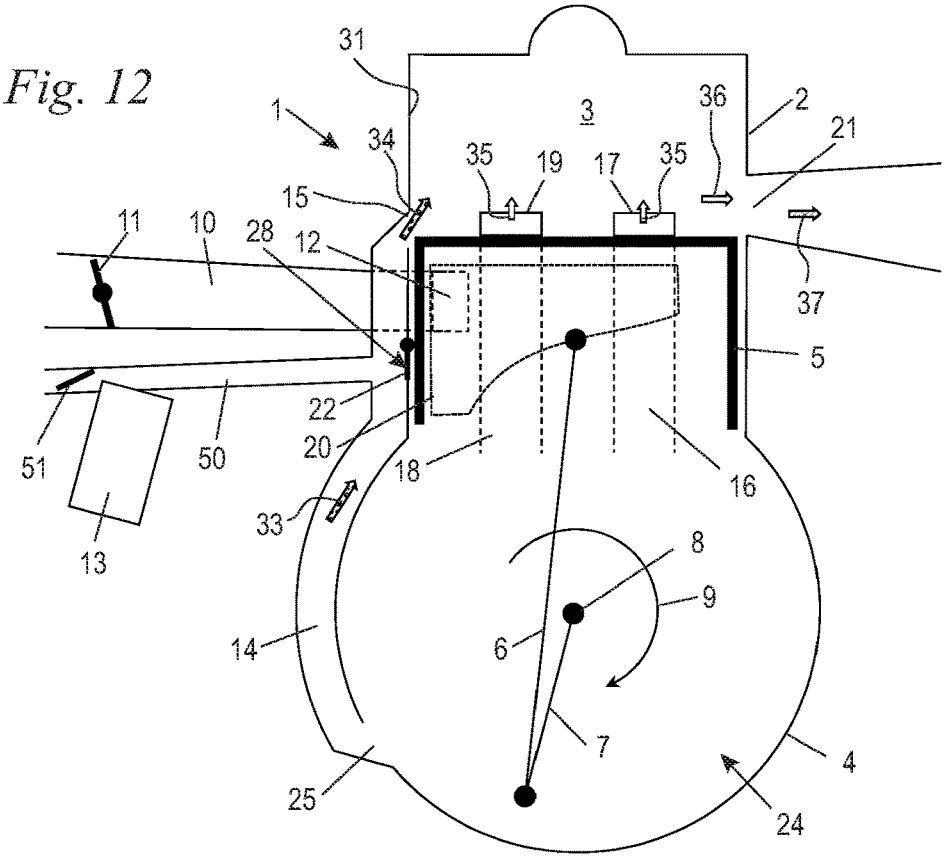

FIG. 12 to FIG. 15 show the operation of the internal combustion engine 1 of FIG. 11 at idle. As shown in FIG. 12, at the beginning of the upward stroke of the piston 5, exhaust gases flow in direction of the arrow 37 out of the combustion chamber 3. Through the transfer passages 16 and 18, air flows in the direction of the arrows 35 through the transfer ports 17 and 19 into the combustion chamber 3. The air pushes the exhaust gases out of the combustion chamber 3, as indicated by the arrow 36. From the first transfer passage 14 fuel/air mixture flows into the combustion chamber 3, as schematically indicated by arrows 33 and 34. In the embodiment according to FIG. 11 to FIG. 19, no valve is arranged at the port opening 25. The port opening 25 is always open relative to the crankcase interior 24 independent of the existing pressure conditions.

Figure 13:
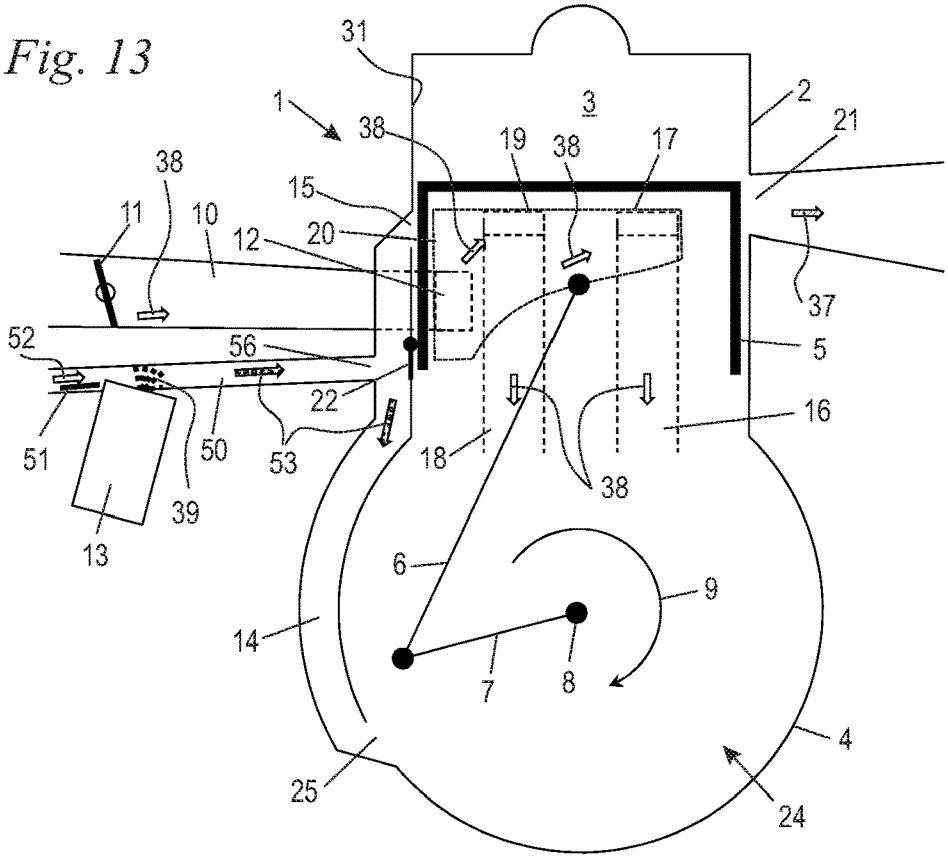

As shown in FIG. 13, as soon as the piston 5 during upward movement has connected the inlet opening 12 with the transfer ports 17 and 19, from the supply channel 10 clean air flows via the piston pocket 20 through the transfer ports 17 and 19 into the transfer passages 16 and 18. This is indicated in FIG. 13 by the arrows 38. Accordingly, in the second and third transfer passages 16 and 18 substantially fuel-free or completely fuel-free air is provided, while in the first transfer passage 14 fuel/air mixture is provided. The transfer port 15 is closed off by piston 5. Clean air is sucked into the intake channel 50 in the direction of the arrow 52. The fuel injection valve 13, for example, injects fuel 39 into the clean air. The thus formed mixture flows through the opening 56 in the direction of the arrows 53 into the first transfer passage 14. The intake is caused by the vacuum which is existing in the crankcase interior 24 during upward stroke of the piston 5.

Figure 14:
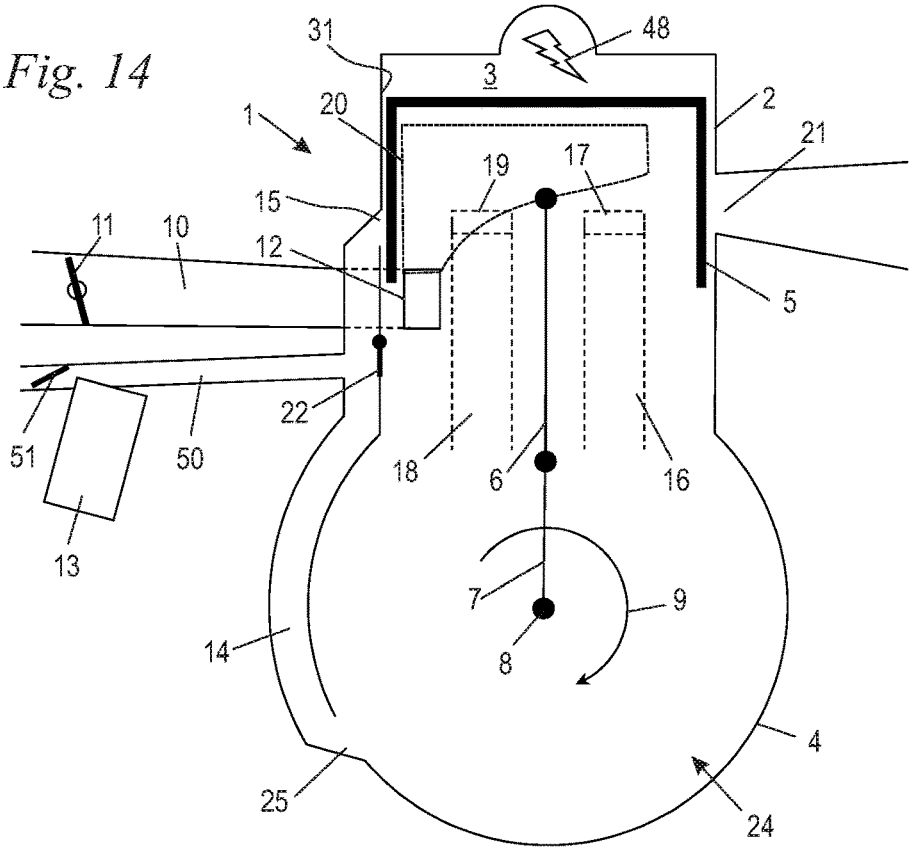
Figure 15:
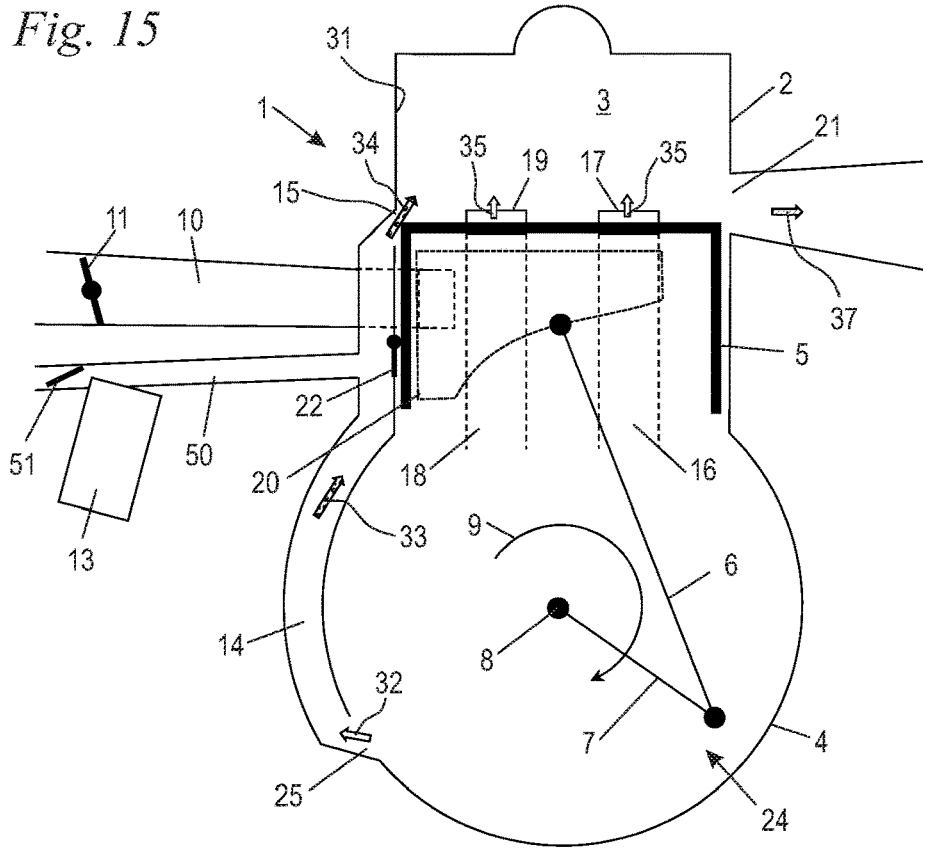
Figure 16:
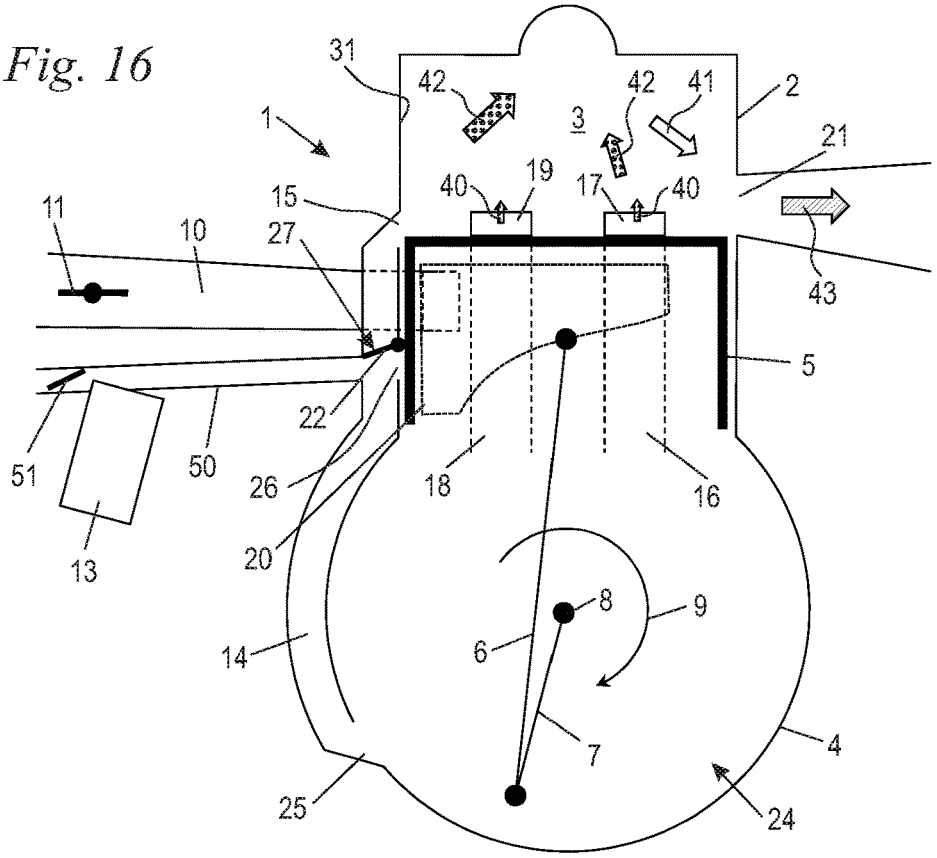

FIG. 14 shows the arrangement at top dead center. The mixture in the combustion chamber 3 is ignited by the spark plug 48. The bottom end of the piston skirt of the piston 5 is arranged advantageously at the side of the inlet opening 12 which is facing the combustion chamber 3. The inlet opening 12 is open toward the crankcase interior 24 so that clean air can flow into the crankcase interior 24 through the inlet opening 12.

During downward stroke of the piston 5 (FIG. 15), as soon as the outlet opening 21 is open, exhaust gases flow in the direction of the arrow 37 out of the combustion chamber 3. Clean air flows from transfer passages 16 and 18 in the direction of the arrows 35 into the combustion chamber 3. From the first transfer passage 14, mixture flows in the direction of the arrows 33 and 34 into the combustion chamber 3. Since the transfer ports 17 and 19 are arranged closer to the outlet opening 21 then the transfer port 15, the clean air separates the exhaust gases from the incoming fresh mixture. Through the port opening 25 clean air flows in the direction of the arrow 32 into the first transfer passage 14.

FIGS. 16 to 19 show the arrangement of the further preferred embodiment of FIG. 11 at full load. The engine speed n with open throttle element 11 is higher than the first engine speed $n_1$. The control element 22 at full load is in the first control position 27 in which the control element 22 opens the connecting opening 26. Particularly preferred, the first transfer passage 14 between the connecting opening 26 and the transfer port 15 is closed relative to the combustion chamber 3 in the first control position 27. In this control position, the first transfer passage 14 is at least partially without function. During upward stroke of the piston 5, exhaust gases flow in the direction of the arrow 43 out of the combustion chamber 3 through the open outlet opening 21. The exhaust gases are purged by clean air which flows in the direction of the arrow 41 out of the combustion chamber 3. The clean air which is flowing in the direction of the arrow 41 is the scavenging air provided in the transfer passages 16 and 18, as will be explained in the following in connection with FIG. 17. Subsequently, the mixture flows in the direction of the arrows 40, 42 out of the crankcase interior 24 into the combustion chamber 3 through the transfer passages 16 and 18.

Figure 17:
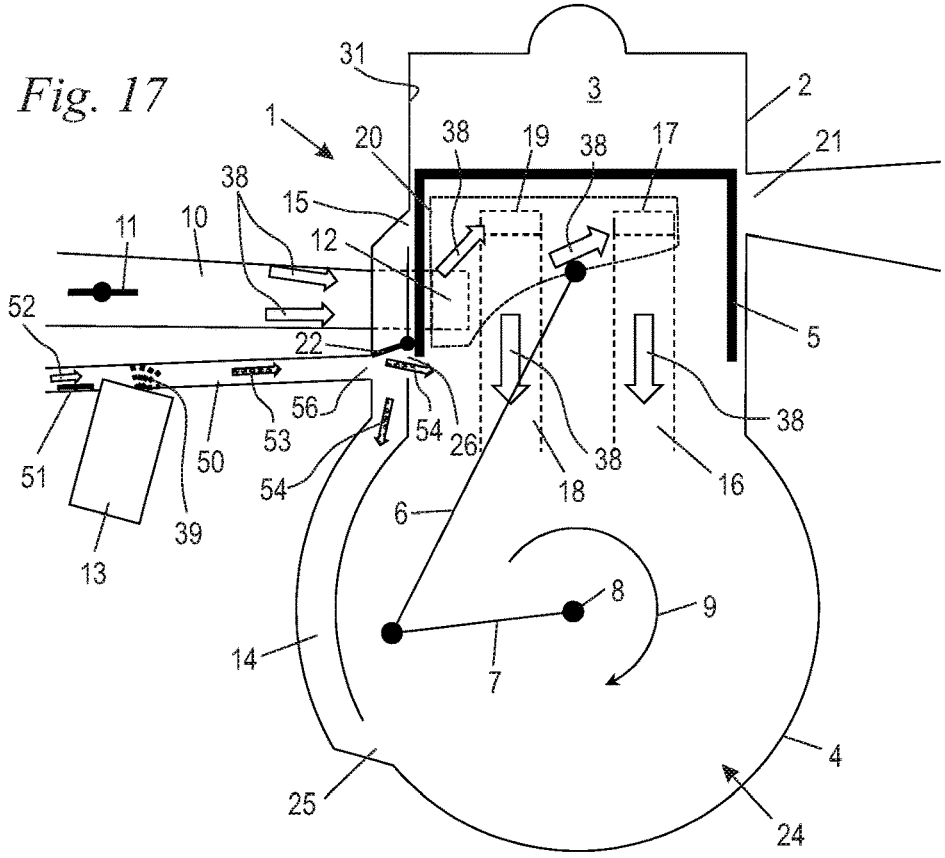

FIG. 17 shows the piston 5 during further upward movement in the direction toward top dead center (TDC). During further upward stroke of the piston 5, the inlet opening 12 is connected by the piston pocket 20 to the transfer ports 17 and 19. Therefore, clean air flows from the supply channel 10 in the direction of the arrow 38 through inlet opening 12, the piston pocket 20, and the transfer ports 17 and 19 into the transfer passages 16 and 18 and is stored therein. This clean scavenging air separates in FIG. 16 the exhaust gases flowing out in the direction of the arrow 43 from the fresh mixture which is coming in the direction of the arrows 40 and 42.

The connecting opening 26 is open in the piston position illustrated in FIG. 17 and connects the intake channel 50 to the crankcase interior 24. Clean air is sucked in the direction of the arrow 52 into the intake channel 50. Advantageously, the fuel injection valve 13 injects fuel 39 into the clean air. The thus formed mixture flows in the direction of the arrow 53 to the opening 56 and from there in the direction of the arrows 54 into the first transfer passage 14 and through the connecting opening 26 into the crankcase interior 24. A portion of the mixture flows in this context in the first transfer passage 14 in the direction toward the port opening 25. The first transfer passage 14 can be closed by the control valve 22 in the flow direction to the transfer port 15.

Figure 18:
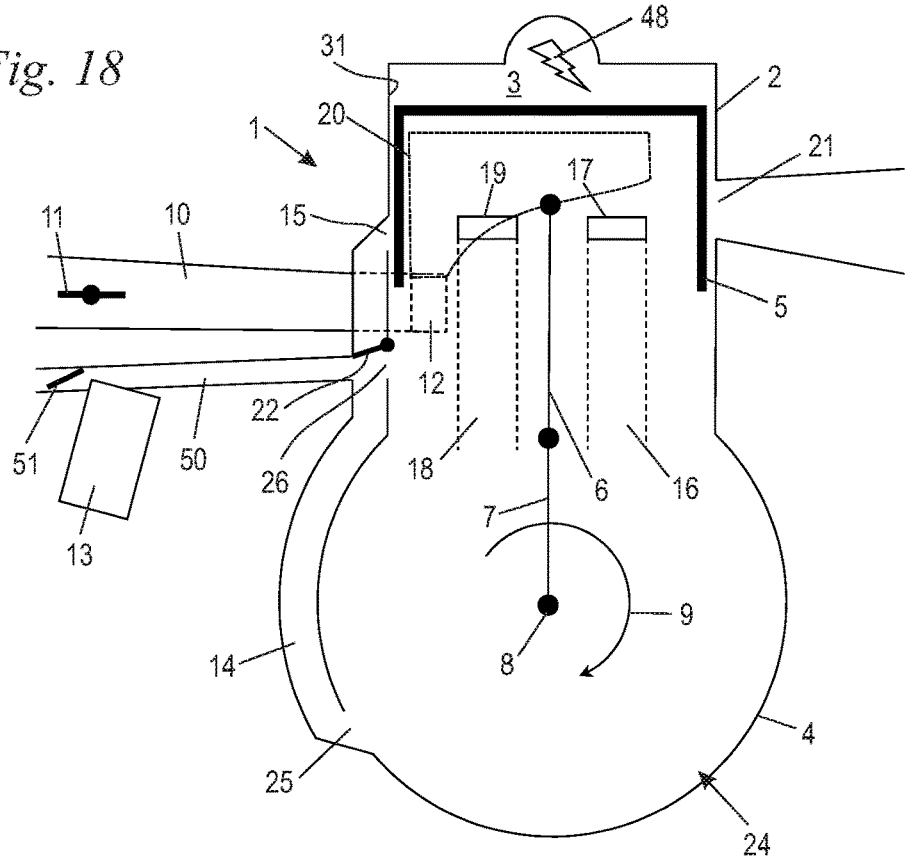

FIG. 18 shows the arrangement of the further preferred embodiment of FIG. 11 at top dead center. In the combustion chamber 3, the mixture in the region of top dead center is ignited by the spark plug 48. Advantageously, the ignition is carried out shortly before top dead center. The inlet opening 12 is open toward the crankcase interior 24 so that through the inlet opening 12 air can flow from the supply channel 10 into the crankcase interior 24.

Figure 19:
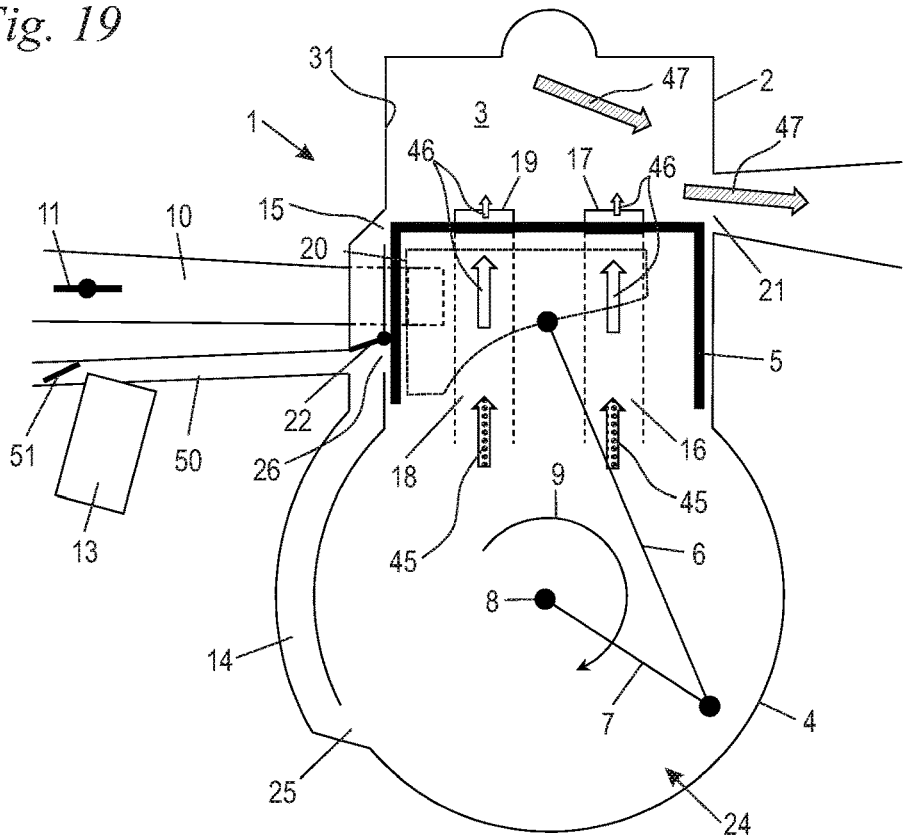

FIG. 19 shows the arrangement after further downward stroke of the piston 5. The outlet opening 21 is open so that the exhaust gases can flow in the direction of arrow 47 out of the combustion chamber 3. Through the transfer passages 16 and 18, first the clean air which is provided in the transfer passages 16 and 18 flows in the direction of the arrows 46 into the combustion chamber 3 and purges the exhaust gases out of the combustion chamber 3. Subsequently, mixture flows in the direction of the arrows 45 out of the crankcase interior 24 through the transfer passages 16 and 18 into the combustion chamber 3. Then the next revolution of the crankshaft 7 begins, as illustrated by FIGS. 16 to 19.

The specification incorporates by reference the entire disclosure of German priority document 10 2018 003 476.4 having a filing date of Apr. 24, 2018.

While specific embodiments of the invention have been shown and described in detail to illustrate the inventive principles, it will be understood that the invention may be embodied otherwise without departing from such principles.

What is claimed is:

1. An internal combustion engine comprising:

a cylinder comprising a combustion chamber arranged in an interior of the cylinder;

a piston supported reciprocatingly in the interior of the cylinder and delimiting the combustion chamber;

a crankcase connected to the cylinder;

a crankshaft rotatably supported in the crankcase to rotate about an axis of rotation, wherein the piston is operatively connected to the crankshaft so as to drive the crankshaft in rotation;

at least one first transfer passage providing a flow communication between a crankcase interior of the crankcase and the combustion chamber when the piston is at bottom dead center;

wherein the at least one first transfer passage comprises a port opening connecting the at least one first transfer passage to the crankcase interior and further comprises at least one first transfer port connecting the at least one first transfer passage to the combustion chamber;

a fuel supply device configured to supply fuel into the at least one first transfer passage at a location between the at least one first transfer port and the port opening;

wherein the at least one first transfer passage further comprises, in addition to the port opening and the at least one first transfer port, a connecting opening, wherein the at least one first transfer passage is connected to the crankcase interior at the connecting opening;

a control element configured to control the connecting opening;

wherein the control element comprises a first control position and a second control position, wherein the control element opens a flow cross section of the connecting opening in the first control position and closes at least partially the flow cross section of the connecting opening in the second control position;

wherein the control element is adjustable independent of a rotational position of the crankshaft between the first control position and the second control position.

2. The internal combustion engine according to claim 1, wherein the control element completely closes the flow cross section of the connecting opening in the second control position.

3. The internal combustion engine according to claim 1, further comprising a control device for controlling the control element.

4. The internal combustion engine according to claim 3, wherein the control device is configured to actuate the control element as a function of an engine speed of the internal combustion engine.

5. The internal combustion engine according to claim 3, further comprising a throttle element configured to control at least a partial quantity of a combustion air quantity supplied to the internal combustion engine, wherein the control device is configured to actuate the control element as a function of a position of the throttle element.

6. The internal combustion engine according to claim 1, wherein means are provided which, in the first control position of the control element, interrupt a connection of the crankcase interior to the combustion chamber, wherein the connection extends through the at least one first transfer passage.

7. The internal combustion engine according to claim 1, wherein the control element is a mechanical control element.

8. An internal combustion engine comprising:

a cylinder comprising a combustion chamber arranged in an interior of the cylinder;

a piston supported reciprocatingly in the interior of the cylinder and delimiting the combustion chamber;

a crankcase connected to the cylinder;

a crankshaft rotatably supported in the crankcase to rotate about an axis of rotation, wherein the piston is operatively connected to the crankshaft so as to drive the crankshaft in rotation;

at least one first transfer passage providing a flow communication between a crankcase interior of the crankcase and the combustion chamber when the piston is at bottom dead center;

wherein the at least one first transfer passage comprises a port opening connecting the at least one first transfer passage to the crankcase interior and further comprises at least one first transfer port connecting the at least one first transfer passage to the combustion chamber;

a fuel supply device configured to supply fuel into the at least one first transfer passage at a location between the at least one first transfer port and the port opening;

wherein the at least one first transfer passage further comprises, in addition to the port opening and the at least one first transfer port, a connecting opening, wherein the at least one first transfer passage is connected to the crankcase interior at the connecting opening;

a control element configured to control the connecting opening;

wherein, independent of a rotational position of the crankshaft, the connecting opening is at least partially closed when the internal combustion engine operates at idle, and wherein, independent of the rotational position of the crankshaft, the connecting opening is open when the internal combustion engine operates at full load.

9. The internal combustion engine according to claim 1, wherein the internal combustion engine comprises an intake channel for supply of fuel/air mixture and wherein the intake channel opens into the at least one first transfer passage.

10. The internal combustion engine according to claim 1, wherein the combustion chamber comprises an outlet opening and wherein the at least one first transfer port is arranged at the cylinder opposite to the outlet opening.

11. The internal combustion engine according to claim 1, further comprising a valve arranged at the port opening.

12. The internal combustion engine according to claim 1, further comprising a supply channel for supply of substantially fuel-free air, wherein the supply channel comprises an inlet opening, wherein the inlet opening opens at a cylinder bore of the cylinder and, in at least one position of the piston, the inlet opening is connected by a piston pocket of the piston to at least one second transfer port of a second transfer passage.

13. A method for operating an internal combustion engine, wherein the internal combustion engine comprises a cylinder comprising a combustion chamber arranged in an interior of the cylinder; a piston supported reciprocatingly in the interior of the cylinder and delimiting the combustion chamber; a crankcase connected to the cylinder; a crankshaft rotatably supported in the crankcase to rotate about an axis of rotation, wherein the piston is operatively connected to the crankshaft so as to drive the crankshaft in rotation; at least one first transfer passage providing a flow communication between a crankcase interior of the crankcase and the combustion chamber when the piston is at bottom dead center, wherein the at least one first transfer passage comprises a port opening connecting the at least one first transfer passage to the crankcase interior and further comprises at least one first transfer port connecting the at least one first transfer passage to the combustion chamber; a fuel supply device configured to supply fuel into the at least one first transfer passage at a location between the at least one first transfer port and the port opening; the method comprising:

providing, in addition to the port opening and the at least one first transfer port, the at least one first transfer passage with a connecting opening and connect the at least one first transfer passage to the crankcase interior at the connecting opening;

providing a control element configured to control the connecting opening, wherein the control element comprises a first control position that opens a flow cross section of the connecting opening and further comprises a second control position that at least partially closes off the flow cross-section of the connecting opening;

adjusting the control element between the first control position and the second control position, independent of a rotational position of the crankshaft, as a function of an engine speed of the internal combustion engine; as a function of a position of a throttle element of the internal combustion engine; or as a function of the engine speed of the internal combustion engine and the position of the throttle element of the internal combustion engine.

14. The method according to claim 13, further comprising adjusting the control element to the first control position when the engine speed surpasses a first engine speed that is above an idle engine speed and adjusting the control element to the second control position when the engine drops below the first engine speed.

* * * * *